US011712612B2

(12) United States Patent
De las Casas Zolezzi et al.

(10) Patent No.: US 11,712,612 B2
(45) Date of Patent: Aug. 1, 2023

(54) EXERCISE MACHINE

(71) Applicants: Humberto De las Casas Zolezzi, Cleveland, OH (US); Reza Lavasanijou, Cleveland, OH (US); Farbod Rohani, Lakewood, OH (US)

(72) Inventors: Humberto De las Casas Zolezzi, Cleveland, OH (US); Reza Lavasanijou, Cleveland, OH (US); Farbod Rohani, Lakewood, OH (US)

( * ) Notice: Subject to any disclaimer, the term of this patent is extended or adjusted under 35 U.S.C. 154(b) by 242 days.

(21) Appl. No.: 16/881,818

(22) Filed: May 22, 2020

(65) Prior Publication Data

US 2021/0077884 A1 Mar. 18, 2021

Related U.S. Application Data

(60) Provisional application No. 62/823,582, filed on Mar. 25, 2019.

(51) Int. Cl.
*A63B 71/00* (2006.01)
*A63B 21/005* (2006.01)
(Continued)

(52) U.S. Cl.
CPC ..... *A63B 71/0054* (2013.01); *A63B 1/00* (2013.01); *A63B 21/0058* (2013.01);
(Continued)

(58) Field of Classification Search
CPC ... A63B 71/0054; A63B 1/00; A63B 21/0058; A63B 21/0724; A63B 21/0783;
(Continued)

(56) References Cited

U.S. PATENT DOCUMENTS 4,934,694 A * 6/1990 McIntosh ..... A63B 21/154 73/379.06
7,163,488 B2 * 1/2007 Anders ..... A63B 21/0783 482/4

(Continued)

FOREIGN PATENT DOCUMENTS

CN 109011342 A * 12/2018 ..... A63B 21/0724
KR 101744047 B1 * 6/2017 ..... A63B 21/00

*Primary Examiner* — Sundhara M Ganesan
(74) *Attorney, Agent, or Firm* — Summit Patent Group, LLC

(57) ABSTRACT

One or more apparatuses are provided. In an example, an exercise machine is provided. The exercise machine may include one or more driving elements connected to one or more motors controlled by a computer. The one or more motors may be configured to provide an electromechanical resistance via the one or more driving elements. The electromechanical resistance may be controlled by smart algorithms running on the computer such that variable resistance is provided at different parts of movement. The algorithms may use readings from one or more sensors. The exercise machine may include a controller configured to control the motor based upon one or more inputs. The exercise machine may include an exercise bar. The exercise machine may include a screen. The exercise machine may include safety actuators. The exercise machine may be fixed on its place or may be portable. The exercise machine may include electromechanical safety stand(s).

16 Claims, 8 Drawing Sheets

(51) Int. Cl.

| | |
|---|---|
| ***A63B 24/00*** | (2006.01) |
| ***A63B 21/078*** | (2006.01) |
| ***A63B 1/00*** | (2006.01) |
| ***A63B 21/00*** | (2006.01) |
| ***A63B 21/072*** | (2006.01) |
| ***A63B 71/06*** | (2006.01) |

(52) U.S. Cl.
CPC ..... *A63B 21/0724* (2013.01); *A63B 21/0783* (2015.10); *A63B 21/154* (2013.01); *A63B 24/0087* (2013.01); *A63B 71/0622* (2013.01); *A63B 21/0053* (2013.01); *A63B 2024/0065* (2013.01); *A63B 2024/0068* (2013.01); *A63B 2024/0093* (2013.01); *A63B 2071/0081* (2013.01); *A63B 2071/068* (2013.01); *A63B 2071/0683* (2013.01); *A63B 2220/13* (2013.01); *A63B 2220/30* (2013.01); *A63B 2220/40* (2013.01); *A63B 2220/51* (2013.01); *A63B 2220/53* (2013.01); *A63B 2220/806* (2013.01); *A63B 2220/807* (2013.01); *A63B 2220/89* (2013.01); *A63B 2225/093* (2013.01); *A63B 2225/15* (2013.01); *A63B 2225/20* (2013.01); *A63B 2225/50* (2013.01); *A63B 2230/062* (2013.01); *A63B 2230/438* (2013.01); *A63B 2230/605* (2013.01)

(58) Field of Classification Search
CPC . A63B 21/154; A63B 24/0087; A63B 21/078; A63B 21/00181; A63B 71/0622; A63B 21/0053; A63B 2024/0065; A63B 2024/0068; A63B 2024/0093; A63B 2071/0081; A63B 2071/068; A63B 2071/0683; A63B 2220/13; A63B 2220/30; A63B 2220/40; A63B 2220/51; A63B 2220/53; A63B 2220/806; A63B 2220/807; A63B 2220/89; A63B 2225/093; A63B 2225/15; A63B 2225/20; A63B 2225/50; A63B 2230/062; A63B 2230/438; A63B 2230/605
See application file for complete search history.

(56) References Cited

U.S. PATENT DOCUMENTS

| | | | | |
|---|---|---|---|---|
| 7,578,774 | B1 * | 8/2009 | Zetterberg | A63B 1/00 482/92 |
| 7,963,886 | B1 * | 6/2011 | Schwinn | A63B 21/0783 482/99 |
| 7,998,038 | B2 * | 8/2011 | Keiser | A63B 21/00069 482/112 |
| 9,174,086 | B1 | 11/2015 | Griggs | |
| 9,272,179 | B2 * | 3/2016 | Lemos | A63B 21/4043 |
| 9,700,753 | B1 * | 7/2017 | Boatwright | A63B 24/0062 |
| 9,707,435 | B1 * | 7/2017 | Ferlito | A63B 21/28 |
| 10,080,916 | B2 * | 9/2018 | Lee | A63B 21/154 |
| 10,143,880 | B1 * | 12/2018 | Boatwright | A63B 21/078 |
| 10,220,235 | B2 * | 3/2019 | Norris | A63B 21/018 |
| 10,456,614 | B1 * | 10/2019 | Dube | A63B 24/0062 |
| 2011/0275481 | A1 * | 11/2011 | Greenhill | A63B 21/0058 482/92 |
| 2012/0058859 | A1 * | 3/2012 | Elsom-Cook | A63B 21/00181 482/4 |
| 2013/0190143 | A1 * | 7/2013 | Greenhill | A63B 21/00181 482/104 |
| 2014/0038777 | A1 * | 2/2014 | Bird | A63B 23/03525 482/5 |
| 2014/0213414 | A1 * | 7/2014 | Balandis | A63B 21/169 482/111 |
| 2016/0339294 | A1 * | 11/2016 | Blach | A63B 21/04 |
| 2017/0282015 | A1 * | 10/2017 | Wicks | A63B 24/0075 |
| 2017/0340502 | A1 * | 11/2017 | Roh | A63B 21/4045 |
| 2018/0064992 | A1 * | 3/2018 | Rothman | H04N 7/188 |
| 2018/0214729 | A1 * | 8/2018 | Rubin | A63B 24/0087 |
| 2018/0290001 | A1 * | 10/2018 | Baek | A63B 17/04 |
| 2018/0326241 | A1 * | 11/2018 | Huskins | A63B 21/0058 |
| 2018/0326242 | A1 * | 11/2018 | Jaquish | A63B 21/00069 |
| 2019/0308071 | A1 * | 10/2019 | Diety | A63B 21/0783 |
| 2019/0329086 | A1 * | 10/2019 | Rindfleisch | A63B 21/0622 |

* cited by examiner

EXERCISE MACHINE

RELATED APPLICATION

This application claims the benefit of U.S. Provisional Application No. 62/823,582, filed Mar. 25, 2019, which is incorporated herein by reference in its entirety.

BACKGROUND

Exercise equipment, such as free weights, mechanical exercise machines, etc. may be used by a user to stay in shape and/or build muscle. However, using free weights is known to have a risk of injury and mechanical exercise machines may not adequately activate the user's stabilizer muscles.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, an exercise machine is provided. In some examples, the exercise machine may comprise an exercise bar. The exercise machine may comprise a driving element coupled to the exercise bar. The exercise machine may comprise a motor coupled to the driving element. The motor may be configured to apply force to the exercise bar via the driving element. The exercise machine may comprise a controller configured to control the motor based upon one or more inputs.

In an example, a bench press machine is provided. In some examples, the bench press machine may comprise a bench. The exercise machine may comprise a barbell. The exercise machine may comprise a barbell support structure. The barbell support structure may comprise a first barbell support component and/or a second barbell support component. The first barbell support component and the second barbell support component may be configured to support the barbell. The bench press machine may comprise a driving mechanism coupled to the barbell. The bench press machine may comprise one or more motors coupled to the driving mechanism. The one or more motors may be configured to apply force to the barbell via the driving mechanism. The bench press machine may comprise a controller configured to control the one or more motors based upon one or more inputs.

In an example, a bench press machine is provided. In some examples, the bench press machine may comprise a bench. The exercise machine may comprise a barbell. The exercise machine may comprise a barbell support structure. The barbell support structure may comprise a first barbell support component and/or a second barbell support component. The first barbell support component and the second barbell support component may be configured to support the barbell. The bench press machine may comprise a driving mechanism coupled to the barbell. The bench press machine may comprise one or more motors coupled to the driving mechanism. The one or more motors may be configured to apply force to the barbell via the driving mechanism. The bench press machine may comprise a controller configured to control the one or more motors based upon one or more inputs. The bench press machine may comprise one or more sensors. The one or more sensors may be configured to detect a position of the barbell, a direction of motion of the barbell, a velocity of the barbell, a force applied on the exercise bar, a ground reaction force, and/or an acceleration of the barbell The one or more sensors may be configured to transmit one or more signals to the controller. Each signal of the one or more signals may be indicative of a position of the barbell, a direction of motion of the barbell, a velocity of the barbell, a force applied on the exercise bar, a ground reaction force, and/or an acceleration of the barbell detected by the one or more sensors. The one or more inputs may comprise the one or more signals. The controller may be configured to compare one or more positions, one or more directions, one or more velocities, one or more forces, and/or one or more accelerations indicated by the one or more signals with one or more safety parameters to determine whether an unsafe condition is met. The controller may be configured to stop the one or more motors from applying the force and/or reduce the force of the one or more motors responsive to a determination that the unsafe condition is met.

DESCRIPTION OF THE DRAWINGS

While the techniques presented herein may be embodied in alternative forms, the particular embodiments illustrated in the drawings are only a few examples that are supplemental of the description provided herein. These embodiments are not to be interpreted in a limiting manner, such as limiting the claims appended hereto.

DETAILED DESCRIPTION

Figure 1:
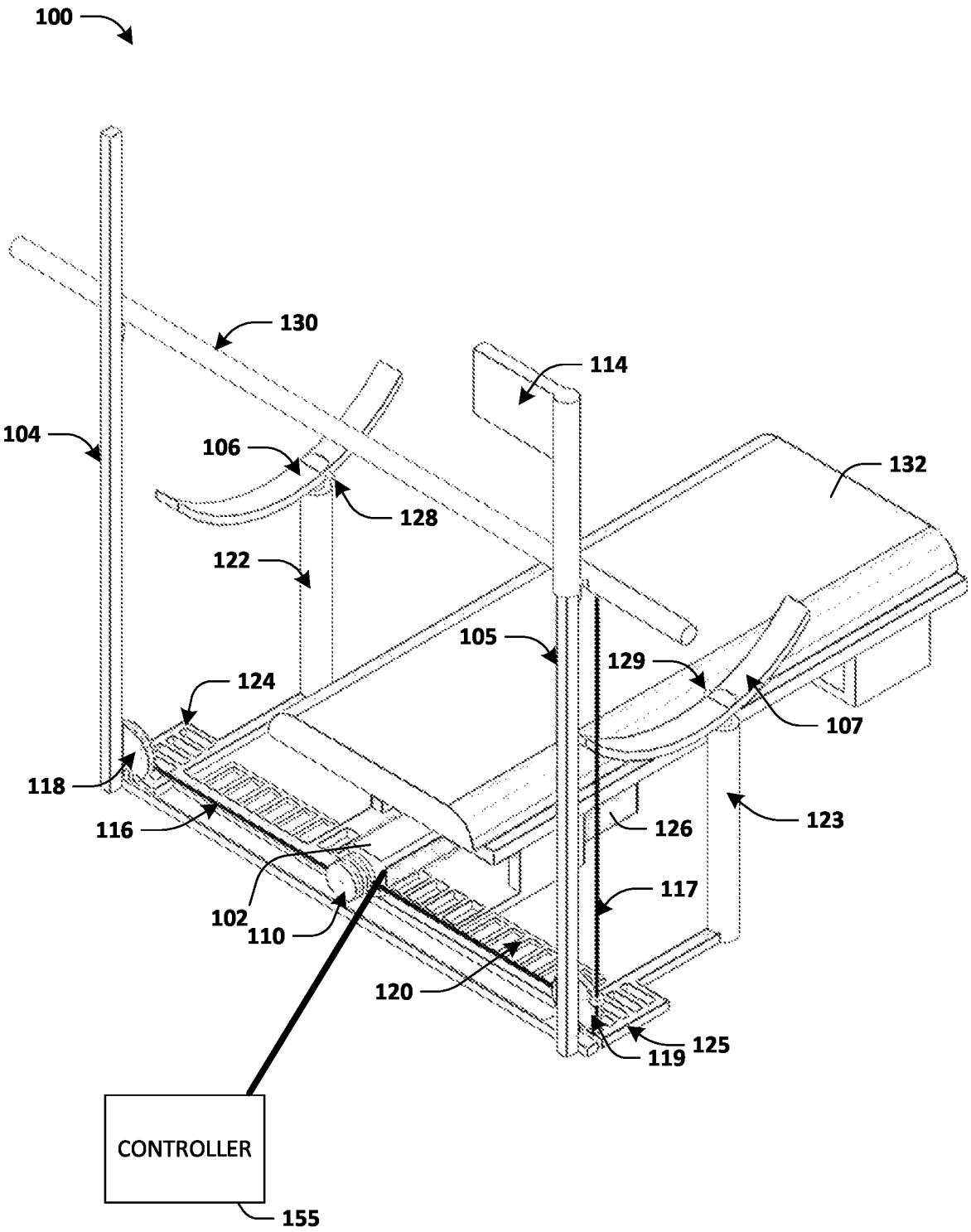
FIG. 1 is an illustration of a perspective view of an exercise machine, according to one exemplary embodiment.

Subject matter will now be described more fully hereinafter with reference to the accompanying drawings, which form a part hereof, and which show, by way of illustration, specific example embodiments. This description is not intended as an extensive or detailed discussion of known concepts. Details that are known generally to those of ordinary skill in the relevant art may have been omitted, or may be handled in summary fashion.

The following subject matter may be embodied in a variety of different forms, such as methods, devices, components, and/or systems. Accordingly, this subject matter is not intended to be construed as limited to any example embodiments set forth herein. Rather, example embodiments are provided merely to be illustrative. Such embodiments may, for example, take the form of mechanical devices, electromechanical devices, electrical devices or any combination thereof.

It may be appreciated that the term "vertical" as used herein intends to describe an orientation, a direction and/or an alignment parallel, or substantially parallel, to the direction of the force of gravity (e.g., the direction of Earth's gravitational pull).

The term "horizontal" as used herein intends to describe an orientation, a direction and/or an alignment perpendicular, or substantially perpendicular, to the vertical direction.

An exercise machine is provided. In some embodiments, the exercise machine is a resistance training (e.g., weight training) exercise machine. In some embodiments, the exercise machine may be used for performing one or more types of exercises. The one or more types of exercises may comprise exercises for strengthening and/or toning muscles of a user, for example. In some embodiments, the exercise machine may be adjustable to provide for a plurality of types of exercises.

In some embodiments, the exercise machine comprises one or more exercise bars, one or more driving elements, one or more motors and/or a controller. In some embodiments, the one or more driving elements are coupled to the one or more exercise bars and the one or more motors. The one or more motors may be configured to generate one or more forces and apply the one or more forces to the one or more exercise bars via the one or more driving elements. In some embodiments, a motor of the one or more motors may be an electric motor. Alternatively and/or additionally, a motor of the one or more motors may be a different type of motor. In some embodiments, the controller is configured to control the one or more motors, such as control the one or more forces of the one or more motors, based upon one or more inputs.

A user may perform a first exercise process by interacting with the exercise bar. For example, the one or more exercise bars may be gripped and/or grasped by the user and/or positioned on and/or adjacent to one or more body parts of the user. The term "exercise bar" as used herein, may correspond to an interface between the user and the exercise machine that the user interacts with to perform the first exercise process, such as at least one of a bar, a barbell, a grip, a dumbbell, a shaped bar, a handle, a bar surrounded by a roller pad, a plate to which the user applies force using one or more of the user's body parts, etc. The one or more exercise bars may comprise, be connected to and/or be a part of at least one of a barbell, one or more grips, one or more dumbbells, one or more shaped bars (e.g., an EZ curl bar, a triceps bar, a hexagon-shaped bar, etc.), one or more different types of bars, one or more handles, a bar surrounded by a roller pad (e.g., such as for application and/or positioning on a body part of the user), one or more plates, etc.

The exercise machine may comprise a seat and/or a bench for the user to sit and/or lay upon. Alternatively and/or additionally, a seat and/or a bench may not be used by the user when performing the first exercise process.

In some embodiments, the user may perform the first exercise process by moving the one or more exercise bars, such as by pressing the one or more exercise bars at least one of upwards, outwards, downwards, sideways, rotationally, in a curved direction, etc., pulling the one or more exercise bars at least one of inwards, upwards, downwards, sideways, rotationally, in a curved direction, etc. with at least one of arms, legs, core muscles, etc. of the user. The movement of the one or more exercise bars may be performed by movement (e.g., at least one of pushing, pulling, flexing, extension, squatting, lunging, bending, twisting, rotating, etc.) of one or more body parts of the user.

The one or more forces of the one or more motors of the exercise machine may be applied to the one or more exercise bars to provide resistance to the movement of the one or more exercise bars in at least one phase of the first exercise process. A net force applied by the one or more motors to an exercise bar of the one or more exercise bars may be in a first direction. The first direction may be opposite to the user's movement of the exercise bar in at least one phase of the first exercise process (e.g., concentric phase and/or eccentric phase) to provide the resistance. The one or more motors of the exercise machine may apply the one or more forces to the one or more exercise bars via the one or more driving elements, one or more pulleys, and/or one or more other power transfer components.

In some embodiments, a driving element of the one or more driving elements may comprise a cable (e.g., a round cable having a round cross-sectional profile, a flat cable having a rectangular cross-sectional profile, a toothed cable, and/or a different type of cable), a rope, a belt (e.g., a round belt having a round cross-sectional profile, a flat belt having a rectangular cross-sectional profile, a toothed belt, and/or a different type of belt) and/or a chain. The driving element may be coupled to a motor of the one or more motors via a driving component, such as a pulley (e.g., a driving pulley). The driving element may be coupled to an exercise bar of the one or more exercise bars. In an example, the driving element may be coupled (e.g., affixed and/or fixedly coupled) to the driving component at a first part (e.g., a first end) of the driving element and/or the driving element may be coupled (e.g., affixed and/or fixedly coupled) to the exercise bar at a second part (e.g., a second end opposite the first end) of the driving element. In some embodiments, the driving element may be coupled to at least one pulley of the one or more pulleys. A pulley of the at least one pulley may have a surrounding groove through at least part of which the driving element is positioned. The at least one pulley may be positioned such that force applied by the motor to the exercise bar is in a desired direction (such as the first direction).

In some embodiments, the exercise machine may comprise one or more first sensors. The one or more first sensors may be used for measuring and/or determining one or more parameters associated with the first exercise process. For example, the one or more first sensors may be configured to detect first information, such as one or more positions of the one or more exercise bars, one or more positions of the one or more motors, one or more directions of motion of the one or more exercise bars, one or more velocities of the one or more exercise bars, one or more accelerations of the one or more exercise bars, one or more forces associated with the one or more exercise bars and/or one or more other parameters. In some embodiments, a position of the one or more positions may be indicative of one or more of a position in space of an exercise bar at a current time (e.g., the position may comprise coordinates specifying a location of the exercise bar in three-dimensional space and/or one or more distances between the exercise bar and one or more reference locations) and/or an orientation of the exercise bar at the current time (e.g., one or more angles of tilt of the exercise bar with respect to one or more reference orientations). In some embodiments, the one or more forces may be indicative of a force, applied by the user, on the one or more exercise bars and/or a force, applied by the one or more motors, on the one or more exercise bars. Alternatively and/or additionally, the one or more forces may be indicative of a resistance applied by the one or more motors to the one or more exercise bars. Alternatively and/or additionally, the one or more forces may be indicative of an interaction force between the user and the exercise machine (and/or an interaction force between the user and the one or more exercise bars of the exercise machine). Alternatively and/or additionally, the one or more forces may be indicative of a ground reaction force.

In some embodiments, the one or more first sensors may comprise at least one of one or more accelerometers, one or more proximity sensors, one or more optical sensors, one or more image sensors, one or more cameras, one or more motion sensors, one or more ultrasonic sensors, one or more infrared sensors, one or more load sensors, etc. configured to determine the first information. In some embodiments, a sensor of the one or more first sensors may be positioned on an exercise bar of the one or more exercise bars (e.g., the sensor may be coupled, such as affixed and/or fixedly coupled, to the exercise bar). Alternatively and/or additionally, a sensor of the one or more first sensors may be positioned away from the one or more exercise bars, such as positioned on an object different than the one or more exercise bars).

In an example, a sensor (e.g., a camera, an image sensor and/or an optical sensor) may be used to capture one or more images and/or one or more videos (comprising a representation of an exercise bar) at various times and/or at least some of the first information associated with an exercise bar may be determined by performing one or more image processing techniques on the one or more images and/or the one or more videos.

In an example, a sensor (e.g., a proximity sensor and/or an ultrasonic sensor) positioned on an object different than the one or more exercise bars may be used for measuring a distance between the sensor and an exercise bar of the one or more exercise bars. At least some of the first information may be determined based upon measurements of the sensor, such as by performing one or more operations (e.g., one or more mathematical operations) using the distance and/or other distances measured by the sensor at various times.

Alternatively and/or additionally, a sensor (e.g., a proximity sensor and/or an ultrasonic sensor) positioned on an exercise bar of the one or more exercise bars may be used for measuring a distance between the sensor and a reference location, such as a location of a different sensor and/or a location of an object. At least some of the first information may be determined based upon measurements of the sensor, such as by performing one or more operations (e.g., one or more mathematical operations) using the distance and/or other distances measured by the sensor at various times.

In some embodiments, the one or more first sensors may be configured to transmit one or more signals to the controller. For example, a signal of the one or more signals may be transmitted to the controller via a wired connection (e.g., one or more electrical wires connecting one or more sensors of the one or more first sensors to the controller). Alternatively and/or additionally, a signal of the one or more signals may be transmitted to the controller via a wireless connection (e.g., at least one of a wireless connection established via a wide area network, such as a public wide-area network (e.g., the Internet) and/or a private network, a wireless connection established via a cellular provider, a wireless connection established via a wireless local area network at a location of the controller such as a Wi-Fi network and/or a Bluetooth personal area network), a wireless connection established via near-field communication (NFC), Light-Fidelity (Li-Fi), ZigBee, Bluetooth Low Energy technology and/or Bluetooth mesh networking technology, etc.). Alternatively and/or additionally, a signal of the one or more signals may be transmitted via an antenna (e.g., an omnidirectional antenna structure and/or a unidirectional antenna structure) of a sensor. In some embodiments, the one or more signals may be transmitted continuously and/or periodically while the exercise machine is in use (e.g., during the first exercise process) and/or at times that the exercise machine is not in use. The one or more signals may be indicative of the first information. For example, the one or more signals may comprise values corresponding to one or more positions of the one or more exercise bars, one or more positions of the one or more motors, one or more directions of motion of the one or more exercise bars, one or more velocities of the one or more exercise bars, one or more accelerations of the one or more exercise bars, one or more forces associated with the one or more exercise bars and/or one or more other parameters associated with the one or more exercise bars. Alternatively and/or additionally, the one or more signals may comprise measurements and/or other information (e.g., one or more distances, one or more other measured values, one or more images, one or more videos, etc.) from which at least some of the first information may be derived.

In some embodiments, the one or more inputs, based upon which the controller is configured to control the one or more motors, comprises the one or more signals. The first information may be determined based upon the one or more signals. In some embodiments, the controller may monitor and/or record values corresponding to one or more positions of the one or more exercise bars, one or more positions of the one or more motors, one or more directions of motion of the one or more exercise bars, one or more velocities of the one or more exercise bars, one or more accelerations of the one or more exercise bars, one or more forces associated with the one or more exercise bars and/or one or more other parameters. In some embodiments, the values may be determined and/or analyzed periodically (e.g., at a rate of at least one of 10 times per second, once per second, 10 times per minute, once per minute, etc.).

In some embodiments, the controller may control the one or more motors, such as the amount of force applied by the one or more motors on the one or more exercise bars, based upon the values. The controller may control the one or more motors based upon the values using one or more smart algorithms running on the controller. For example, a first set of values may be compared with one or more safety parameters to determine whether an unsafe condition is met. The first set of values may comprise one or more values indicative of one or more measured positions of the one or more exercise bars, one or more values indicative of one or more measured directions of motion of the one or more exercise bars, one or more values indicative of one or more measured velocities of the one or more exercise bars and/or one or more values indicative of one or more measured accelerations of the one or more exercise bars.

The one or more safety parameters may be indicative of one or more first positional parameters associated with safe operation of the exercise machine (and/or safe usage of the exercise machine) and/or one or more second positional parameters associated with unsafe operation of the exercise machine (and/or unsafe usage of the exercise machine). The one or more first positional parameters may be indicative of one or more first ranges and/or one or more first thresholds.

For example, positional values within the one or more first ranges may be associated with safe operation and/or positional values outside the one or more first ranges may be associated with unsafe operation. Alternatively and/or additionally, positional values that meet the one or more first thresholds (e.g., positional values that are less than, greater than and/or equal to the one or more first thresholds) may be associated with safe operation and/or positional values that do not meet the one or more first thresholds may be associated with unsafe operation.

Accordingly, one or more positional values of the first set of values may be compared with the one or more first ranges and/or the one or more first thresholds to determine whether an unsafe condition is met. A positional value of the one or more positional values may comprise at least one of one or more coordinates of a location of an exercise bar, a distance between the exercise bar and a reference location, an angle of tilt of the exercise bar with respect to a reference orientation, etc. It may be determined that an unsafe condition is met based upon a determination that a positional value of the one or more positional values is not within a range of the one or more first ranges and/or that the positional value does not meet a threshold of the one or more first thresholds.

Alternatively and/or additionally, the one or more second positional parameters (associated with unsafe operation and/or usage of the exercise machine) may be indicative of one or more second ranges and/or one or more second thresholds. For example, positional values within the one or more second ranges may be associated with unsafe operation and/or positional values outside the one or more second ranges may be associated with safe operation. Alternatively and/or additionally, positional values that meet the one or more second thresholds may be associated with unsafe operation and/or positional values that do not meet the one or more second thresholds may be associated with safe operation.

Accordingly, the one or more positional values of the first set of values may be compared with the one or more second ranges and/or the one or more second thresholds to determine whether an unsafe condition is met. It may be determined that an unsafe condition is met based upon a determination that a positional value of the one or more positional values (e.g., one or more coordinates of a location of an exercise bar, a distance between the exercise bar and a reference location, an angle of tilt of the exercise bar with respect to a reference orientation, etc.) is within the one or more second ranges and/or that the positional value meets a threshold of the one or more second thresholds.

In an example, a positional value of the one or more positional values of the first set of values may be associated with an orientation of an exercise bar of the one or more exercise bars. The positional value may be indicative of an angle of tilt of the exercise bar with respect to a reference orientation. The positional value may be compared with a range of the one or more second ranges and/or a threshold of the one or more second thresholds. It may be determined that an unsafe condition is met based upon a determination that the positional value (e.g., the angle of tilt with respect to the reference orientation) is within the range (e.g., a range of angles of tilt associated with unsafe operation and/or usage of the exercise machine). Alternatively and/or additionally, it may be determined that an unsafe condition is met based upon a determination that the positional value meets the threshold (e.g., a threshold angle of tilt associated with unsafe operation and/or usage). In an example, the positional value may meet the threshold if the positional value exceeds the threshold (e.g., the angle of tilt of the exercise bar with respect to the reference orientation exceeds the threshold angle of tilt).

The one or more safety parameters may be indicative of one or more first directional parameters associated with safe operation of the exercise machine (and/or safe usage of the exercise machine) and/or one or more second directional parameters associated with unsafe operation of the exercise machine (and/or unsafe usage of the exercise machine). The one or more first directional parameters may be indicative of one or more third ranges and/or one or more third thresholds. For example, directional values within the one or more third ranges may be associated with safe operation and/or directional values outside the one or more third ranges may be associated with unsafe operation. Alternatively and/or additionally, directional values that meet the one or more third thresholds (e.g., directional values that are less than, greater than and/or equal to the one or more third thresholds) may be associated with safe operation and/or directional values that do not meet the one or more third thresholds may be associated with unsafe operation.

Accordingly, one or more directional values of the first set of values may be compared with the one or more third ranges and/or the one or more third thresholds to determine whether an unsafe condition is met. The one or more directional values may be indicative of a direction in which the exercise bar is moving. It may be determined that an unsafe condition is met based upon a determination that a directional value of the one or more directional values is not within a range of the one or more third ranges and/or that the directional value does not meet a threshold of the one or more third thresholds.

Alternatively and/or additionally, the one or more second directional parameters may be indicative of one or more fourth ranges and/or one or more fourth thresholds. For example, directional values within the one or more fourth ranges may be associated with unsafe operation and/or directional values outside the one or more fourth ranges may be associated with safe operation. Alternatively and/or additionally, directional values that meet the one or more fourth thresholds may be associated with unsafe operation and/or directional values that do not meet the one or more fourth thresholds may be associated with safe operation.

Accordingly, the one or more directional values of the first set of values may be compared with the one or more fourth ranges and/or the one or more fourth thresholds to determine whether an unsafe condition is met. It may be determined that an unsafe condition is met based upon a determination that a directional value of the one or more directional values (e.g., a direction in which the exercise bar is moving) is within the one or more fourth ranges and/or that the directional value meets a threshold of the one or more fourth thresholds.

The one or more safety parameters may be indicative of one or more first velocity parameters associated with safe operation of the exercise machine (and/or safe usage of the exercise machine) and/or one or more second velocity parameters associated with unsafe operation of the exercise machine (and/or unsafe usage of the exercise machine). The one or more first velocity parameters may be indicative of one or more fifth ranges and/or one or more fifth thresholds. For example, velocity values within the one or more fifth ranges may be associated with safe operation and/or velocity values outside the one or more fifth ranges may be associated with unsafe operation. Alternatively and/or additionally, velocity values that meet the one or more fifth thresholds (e.g., velocity values that are less than, greater than and/or equal to the one or more fifth thresholds) may be associated with safe operation and/or velocity values that do not meet the one or more fifth thresholds may be associated with unsafe operation.

Accordingly, one or more velocity values of the first set of values may be compared with the one or more fifth ranges and/or the one or more fifth thresholds to determine whether an unsafe condition is met. The one or more velocity values may be indicative of a velocity (e.g., a speed) with which the exercise bar is moving. It may be determined that an unsafe condition is met based upon a determination that a velocity value of the one or more velocity values is not within a range of the one or more fifth ranges and/or that the velocity value does not meet a threshold of the one or more fifth thresholds (e.g., the velocity value may not meet the threshold if the velocity value is less than the threshold, such as where the exercise bar is moving slowly).

Alternatively and/or additionally, the one or more second velocity parameters may be indicative of one or more sixth ranges and/or one or more sixth thresholds. For example, velocity values within the one or more sixth ranges may be associated with unsafe operation and/or velocity values outside the one or more sixth ranges may be associated with safe operation. Alternatively and/or additionally, velocity values that meet the one or more sixth thresholds may be associated with unsafe operation and/or velocity values that do not meet the one or more sixth thresholds may be associated with safe operation.

Accordingly, the one or more velocity values of the first set of values may be compared with the one or more sixth ranges and/or the one or more sixth thresholds to determine whether an unsafe condition is met. It may be determined that an unsafe condition is met based upon a determination that a velocity value of the one or more velocity values (e.g., a velocity with which the exercise bar is moving) is within the one or more sixth ranges and/or that the velocity value meets a threshold of the one or more sixth thresholds (e.g., the velocity value may meet the threshold by exceeding the threshold, such as where the exercise bar is moving quickly).

The one or more safety parameters may be indicative of one or more first acceleration parameters associated with safe operation of the exercise machine (and/or safe usage of the exercise machine) and/or one or more second acceleration parameters associated with unsafe operation of the exercise machine (and/or unsafe usage of the exercise machine). The one or more first acceleration parameters may be indicative of one or more seventh ranges and/or one or more seventh thresholds. For example, acceleration values within the one or more seventh ranges may be associated with safe operation and/or acceleration values outside the one or more seventh ranges may be associated with unsafe operation. Alternatively and/or additionally, acceleration values that meet the one or more seventh thresholds (e.g., acceleration values that are less than, greater than and/or equal to the one or more seventh thresholds) may be associated with safe operation and/or acceleration values that do not meet the one or more seventh thresholds may be associated with unsafe operation.

Accordingly, one or more acceleration values of the first set of values may be compared with the one or more seventh ranges and/or the one or more seventh thresholds to determine whether an unsafe condition is met. The one or more acceleration values may be indicative of an acceleration of the exercise bar. It may be determined that an unsafe condition is met based upon a determination that an acceleration value of the one or more acceleration values is not within a range of the one or more seventh ranges and/or that the acceleration value does not meet a threshold of the one or more seventh thresholds.

Alternatively and/or additionally, the one or more second acceleration parameters may be indicative of one or more eighth ranges and/or one or more eighth thresholds. For example, acceleration values within the one or more eighth ranges may be associated with unsafe operation and/or acceleration values outside the one or more eighth ranges may be associated with safe operation. Alternatively and/or additionally, acceleration values that meet the one or more eighth thresholds may be associated with unsafe operation and/or acceleration values that do not meet the one or more eighth thresholds may be associated with safe operation.

Accordingly, the one or more acceleration values of the first set of values may be compared with the one or more eighth ranges and/or the one or more eighth thresholds to determine whether an unsafe condition is met. It may be determined that an unsafe condition is met based upon a determination that an acceleration value of the one or more acceleration values (e.g., an acceleration of the exercise bar) is within the one or more eighth ranges and/or that the acceleration value meets a threshold of the one or more eighth thresholds (e.g., the acceleration value may meet the threshold by exceeding the threshold, such as where the acceleration of the exercise bar approaches gravitational acceleration).

The one or more safety parameters may be indicative of one or more first force parameters associated with safe operation of the exercise machine (and/or safe usage of the exercise machine) and/or one or more second force parameters associated with unsafe operation of the exercise machine (and/or unsafe usage of the exercise machine). The one or more first force parameters may be indicative of one or more ninth ranges and/or one or more ninth thresholds. For example, force values within the one or more ninth ranges may be associated with safe operation and/or force values outside the one or more ninth ranges may be associated with unsafe operation. Alternatively and/or additionally, force values that meet the one or more ninth thresholds (e.g., force values that are less than, greater than and/or equal to the one or more ninth thresholds) may be associated with safe operation and/or force values that do not meet the one or more ninth thresholds may be associated with unsafe operation.

Accordingly, one or more force values of the first set of values may be compared with the one or more ninth ranges and/or the one or more ninth thresholds to determine whether an unsafe condition is met. The one or more force values may be indicative of a force, applied by the user, on the one or more exercise bars and/or a force, applied by the one or more motors, on the one or more exercise bars. Alternatively and/or additionally, the one or more force values may be indicative of a resistance applied by the one or more motors to the one or more exercise bars. Alternatively and/or additionally, the one or more force values may be indicative of an interaction force between the user and the exercise machine (and/or an interaction force between the user and the one or more exercise bars of the exercise machine). Alternatively and/or additionally, the one or more force values may be indicative of a ground reaction force. It may be determined that an unsafe condition is met based upon a determination that a force value of the one or more force values is not within a range of the one or more ninth ranges and/or that the force value does not meet a threshold of the one or more ninth thresholds.

Alternatively and/or additionally, the one or more second force parameters may be indicative of one or more tenth ranges and/or one or more tenth thresholds. For example, force values within the one or more tenth ranges may be associated with unsafe operation and/or force values outside the one or more tenth ranges may be associated with safe operation. Alternatively and/or additionally, force values that meet the one or more tenth thresholds may be associated with unsafe operation and/or force values that do not meet the one or more tenth thresholds may be associated with safe operation.

Accordingly, the one or more force values of the first set of values may be compared with the one or more tenth ranges and/or the one or more tenth thresholds to determine whether an unsafe condition is met. It may be determined that an unsafe condition is met based upon a determination that a force value of the one or more force values (e.g., an interaction force between the user and the exercise machine, a force applied by the user on the one or more exercise bars, a force applied by the one or more motors on the one or more exercise bars, and/or a ground reaction force) is within the one or more tenth ranges and/or that the force value meets a threshold of the one or more tenth thresholds.

The one or more safety parameters may be indicative of one or more first motor position parameters associated with safe operation of the exercise machine (and/or safe usage of the exercise machine) and/or one or more second motor position parameters associated with unsafe operation of the exercise machine (and/or unsafe usage of the exercise machine). The one or more first motor position parameters may be indicative of one or more eleventh ranges and/or one or more eleventh thresholds. For example, motor position values within the one or more eleventh ranges may be associated with safe operation and/or motor position values outside the one or more eleventh ranges may be associated with unsafe operation. Alternatively and/or additionally, motor position values that meet the one or more eleventh thresholds (e.g., motor position values that are less than, greater than and/or equal to the one or more eleventh thresholds) may be associated with safe operation and/or motor position values that do not meet the one or more eleventh thresholds may be associated with unsafe operation.

Accordingly, one or more motor position values of the first set of values may be compared with the one or more eleventh ranges and/or the one or more eleventh thresholds to determine whether an unsafe condition is met. A motor position value of the one or more motor position values may be indicative of one or more of a position in space of a motor at a current time (e.g., the position may comprise coordinates specifying a location of the motor in three-dimensional space and/or one or more distances between the motor and one or more reference locations), a location of the motor with respect to a movement structure (e.g., the first rail 124, the second rail 125, the third rail 120 and/or a different movement structure), and/or an orientation of the motor at the current time (e.g., one or more angles of tilt of the motor with respect to one or more reference orientations). It may be determined that an unsafe condition is met based upon a determination that a motor position value of the one or more motor position values is not within a range of the one or more eleventh ranges and/or that the motor position value does not meet a threshold of the one or more eleventh thresholds.

Alternatively and/or additionally, the one or more second motor position parameters may be indicative of one or more twelfth ranges and/or one or more twelfth thresholds. For example, motor position values within the one or more twelfth ranges may be associated with unsafe operation and/or motor position values outside the one or more twelfth ranges may be associated with safe operation. Alternatively and/or additionally, motor position values that meet the one or more twelfth thresholds may be associated with unsafe operation and/or motor position values that do not meet the one or more twelfth thresholds may be associated with safe operation.

Accordingly, the one or more motor position values of the first set of values may be compared with the one or more twelfth ranges and/or the one or more twelfth thresholds to determine whether an unsafe condition is met. It may be determined that an unsafe condition is met based upon a determination that a motor position value of the one or more motor position values is within the one or more twelfth ranges and/or that the motor position value meets a threshold of the one or more twelfth thresholds.

In some embodiments, responsive to a determination that an unsafe condition is met, the controller may perform one or more safety operations. In an example, the one or more safety operations may comprise stopping the one or more motors from generating force and/or applying the force to the one or more exercise bars. For example, the controller may transmit a signal, indicative of not generating force and/or not applying force to the one or more exercise bars, to the one or more motors. The one or more motors may stop generating force and/or applying force to the one or more exercise bars responsive to receiving the signal.

Alternatively and/or additionally, the one or more safety operations performed responsive to a determination that the unsafe condition is met may comprise disconnecting the one or more motors from one or more components, such as at least one of the controller, a power source with which the one or more motors are powered, one or more driving elements used for applying force to the one or more exercise bars, etc.

Alternatively and/or additionally, the one or more safety operations performed responsive to a determination that the unsafe condition is met may comprise deactivating, shutting down and/or turning off the one or more motors (such that the one or more motors do not continue applying force to the one or more exercise bars). For example, the controller may transmit a signal, indicative of the one or more motors deactivating, shutting down and/or turning off, to the one or more motors. The one or more motors may deactivate, shut down and/or turn off responsive to receiving the signal.

Alternatively and/or additionally, the one or more safety operations performed responsive to a determination that the unsafe condition is met may comprise reducing the amount of force applied by the one or more motors to the one or more exercise bars. For example, the controller may transmit a signal, indicative of a force and/or a resistance to be applied by the one or more motors to the one or more exercise bars, where the force and/or the resistance are less than a previous force and/or a previous resistance applied by the motor prior to the unsafe condition being met. The one or more motors may generate force and/or apply the force to the one or more exercise bars based upon the fore and/or the resistance indicated in the signal.

By analyzing signals received from the one or more first sensors and/or periodically (and/or continuously) comparing values (e.g., at least one of positional values, directional values, velocity values, acceleration values, etc. associated with the one or more exercise bars) determined based upon the signals with the one or more safety parameters, an unsafe condition may be detected. Examples of unsafe conditions that may be detected comprise at least one of an exercise bar of the one or more exercise bars being tilted at an angle exceeding a threshold, an exercise bar of the one or more exercise bars moving in a direction that does not correspond to an exercise process being performed (e.g., away from the exercise machine), an exercise bar of the one or more exercise bars moving with a velocity greater than a threshold velocity (e.g., such as where the user's grasp on the exercise bar is released and/or the user drops the exercise bar), an exercise bar of the one or more exercise bars moving with an acceleration that greater than a threshold acceleration (e.g., the threshold acceleration may be related to, such as at least one of half of, equal to, etc. gravitational acceleration), etc. By performing the one or more safety operations, a safety risk associated with an unsafe condition is reduced and/or minimized as compared with conventional weight systems that are prone to accidents. Thus, detecting unsafe conditions using one or more of the techniques provided herein and/or performing the one or more safety operations responsive to detecting an unsafe condition leads to safer operation and/or usage of the exercise machine.

In some embodiments, the one or more inputs, based upon which the controller is configured to control the one or more motors, comprises one or more resistance settings. The controller may control the one or more motors based upon the one or more resistance settings using one or more smart algorithms running on the controller. The controller may be configured to set the amount of force, applied by the one or more motors to the one or more exercise bars, to equivalent to a resistance indicated by the one or more resistance settings. For example, a net force applied by the one or more motors to the one or more exercise bars may be equivalent to the resistance indicated by the one or more resistance settings. In an example, the resistance indicated by the one or more resistance settings may be 50 pounds. Thus, the net force applied by the one or more motors to the one or more exercise bars may be equivalent to a resistance of 50 pounds to movement of the one or more exercise bars (e.g., the one or more forces applied by the one or more motors to the one or more exercise bars may provide a resistance equivalent to 50 pounds to movement of the one or more exercise bars in at least one phase of an exercise process performed using the exercise machine).

In some embodiments, the controller may control the one or more motors based upon one or more feedback signals associated with the resistance applied to the one or more exercise bars by the motor. For example, the one or more feedback signals may be received from one or more sensors, such as one or more load sensors and/or one or more other types of sensors. In some embodiments, the one or more feedback signals may be indicative of a force, applied by the user, on the one or more exercise bars and/or a force, applied by the one or more motors, on the one or more exercise bars. Alternatively and/or additionally, the one or more feedback signals may be indicative of a resistance applied by the one or more motors to the one or more exercise bars. Alternatively and/or additionally, the one or more feedback signals may be indicative of an interaction force between the user and the exercise machine. Alternatively and/or additionally, the one or more feedback signals may be indicative of a ground reaction force. The controller may monitor and/or analyze the one or more feedback signals continuously and/or periodically. The controller may regulate the resistance applied by the motor to the one or more exercise bars (such as by controlling and/or adjusting the one or more forces applied by the motors) based upon the one or more feedback signals.

In some embodiments, the controller may control the one or more motors such that the resistance applied by the one or more motors to the one or more exercise bars is in accordance with the one or more resistance settings. In some embodiments, the one or more resistance settings may be indicative of a constant resistance throughout the first exercise process. Accordingly, the controller may control the one or more motors such that the resistance applied by the one or more motors to the one or more exercise bars throughout the first exercise process is equivalent to the constant resistance.

In some embodiments, the one or more resistance settings may be indicative of a plurality of resistances associated with a plurality of conditions. The controller may be configured to control the one or more motors such that the resistance applied by the one or more motors to the one or more exercise bars is equivalent to a resistance of the plurality of resistances when a condition of the plurality of conditions is met.

In an example, the plurality of resistances may comprise a first resistance associated with a first condition of the plurality of conditions and a second resistance associated with a second condition of the plurality of conditions. The controller may be configured to control the one or more motors such that the resistance applied by the one or more motors to the one or more exercise bars is equivalent to the first resistance when the first condition is met. The controller may be configured to control the one or more motors such that the resistance applied by the one or more motors to the one or more exercise bars is equivalent to the second resistance when the second condition is met.

In some embodiments, the plurality of conditions may be associated with a plurality of phases of the first exercise process. A phase of the plurality of phases may correspond to a phase of the first exercise process (e.g., at least one of eccentric phase, concentric phase, isometric phase, etc.). Alternatively and/or additionally, a condition of the plurality of conditions may be associated with a portion of a phase of the first exercise process (e.g., at least one of a portion of the eccentric phase, a portion of the concentric phase, a portion of the isometric phase, etc.).

In an example, the first condition may be associated with the eccentric phase of the first exercise process, the second condition may be associated with the isometric phase of the first exercise process and/or a third condition of the plurality of conditions may be associated with the concentric phase of the first exercise process. During the eccentric phase of the first exercise process, the controller may control the one or more motors such that the resistance applied by the one or more motors to the one or more exercise bars is equivalent to the first resistance (associated with the first condition). Alternatively and/or additionally, during the isometric phase of the first exercise process, the controller may control the one or more motors such that the resistance applied by the one or more motors to the one or more exercise bars is equivalent to the second resistance (associated with the second condition). Alternatively and/or additionally, during the concentric phase of the first exercise process, the controller may control the one or more motors such that the resistance applied by the one or more motors to the one or more exercise bars is equivalent to a third resistance associated with the third condition.

Alternatively and/or additionally, the first condition may be associated with a first portion of the eccentric phase of the first exercise process and/or the second condition may be associated with a second portion of the eccentric phase of the first exercise process. The first portion of the eccentric phase may be a proportion and/or a percentage of the eccentric phase (e.g., the first portion of the eccentric phase may correspond to the first half (and/or a different proportion) of the eccentric phase). The second portion of the eccentric phase may be a proportion and/or a percentage of the eccentric phase (e.g., the second portion of the eccentric phase may correspond to the second half (and/or a different proportion) of the eccentric phase). During the first portion of the eccentric phase of the first exercise process, the controller may control the one or more motors such that the resistance applied by the one or more motors to the one or more exercise bars is equivalent to the first resistance. Alternatively and/or additionally, during the second portion of the eccentric phase of the first exercise process, the controller may control the one or more motors such that the resistance applied by the one or more motors to the one or more exercise bars is equivalent to the second resistance.

In some embodiments, a current condition may be determined based upon one or more signals received from the one or more first sensors (and/or one or more other sensors). For example, the controller may determine the current phase and/or a current portion of the current phase based upon the one or more signals.

In some embodiments, the current phase and/or the current portion of the current phase may be determined based upon one or more videos and/or one or more images received from one or more sensors (e.g., at least one of one or more optical sensors, one or more image sensors, one or more cameras, etc.). For example, the current phase and/or the current portion of the current phase may be determined by performing one or more image processing techniques on the one or more images.

Alternatively and/or additionally, the current phase and/or the current portion of the current phase may be determined based upon values (e.g., at least one of positional values, directional values, velocity values, acceleration values, etc. associated with the one or more exercise bars) determined based upon the one or more signals.

In an example, the current phase and/or the current portion of the current phase may be determined based upon a direction of movement of the one or more exercise bars. For example, a first direction of movement may correspond to the eccentric phase and/or a second direction of movement, such as opposite the first direction, may correspond to the concentric phase. Accordingly, the current phase may be determined to be the eccentric phase responsive to a determination that the one or more exercise bars are moving in the first direction and/or the current phase may be determined to be the concentric phase responsive to a determination that the one or more exercise bars are moving in the second direction.

Alternatively and/or additionally, the current phase and/or the current portion of the current phase may be determined based upon a velocity and/or an acceleration of the one or more exercise bars. For example, a velocity and/or an acceleration being less than a threshold may indicate that the current phase is isometric phase (e.g., the one or more exercise bars may not move and/or are may only slightly move during the isometric phase). Accordingly, the current phase may be determined to be the isometric phase responsive to a determination that the velocity and/or the acceleration are less than the threshold.

Alternatively and/or additionally, the current phase and/or the current portion of the current phase may be determined based upon a position of the one or more exercise bars. For example, during a first portion of the current phase, the one or more exercise bars may have (and/or move through) one or more first positions (such as one or more first elevations and/or one or more first distances from a reference position). Alternatively and/or additionally, during a second portion of the current phase, the one or more exercise bars may have (and/or move through) one or more second positions (such as one or more second elevations and/or one or more second distances from a reference position). Accordingly, the current portion of the current phase may be determined to be the first portion of the current phase responsive to a determination that a position of the one or more exercise bars matches a position of the one or more first positions and/or is within a threshold distance from a position of the one or more first positions. Alternatively and/or additionally, the current portion of the current phase may be determined to be the second portion of the current phase responsive to a determination that a position of the one or more exercise bars matches a position of the one or more second positions and/or is within a threshold distance from a position of the one or more second positions.

In some embodiments, the plurality of conditions may be associated with a plurality of periods of time of the first exercise process. For example, a first condition of the plurality of conditions may be associated with a first period of time of the plurality of periods of time, a second condition of the plurality of conditions may be associated with a second period of time of the plurality of periods of time, etc. In an example, during the first period of time, the controller may control the one or more motors such that the resistance applied by the one or more motors to the one or more exercise bars is equivalent to a first resistance associated with the first condition. Alternatively and/or additionally, during the second period of time, the controller may control the one or more motors such that the resistance applied by the one or more motors to the one or more exercise bars is equivalent to a second resistance associated with the second condition.

The first exercise process performed using the exercise machine may correspond to one or more sets of an exercise, where each set of the one or more sets is performed by performing one or more repetitions of the exercise. In some embodiments, the first exercise process may be associated with a plurality of repetitions of an exercise (e.g., a repetition of the plurality of repetitions may correspond to a complete performance of a set of motions of the exercise). In an example where the first exercise process comprises bench press, a repetition of the plurality of repetitions may comprise a complete performance of both lowering a barbell and lifting a barbell, which is then followed by a next repetition of the plurality of repetitions. In some embodiments, the one or more resistance settings may be indicative of varying resistances across the plurality of repetitions. The controller may control the one or more motors based upon a current repetition of the plurality of repetitions. For example, each repetition of the plurality of repetitions may be associated with one or more resistances, where one or more resistances associated with a repetition of the plurality of repetitions may be different than one or more resistances associated with a different repetition of the plurality of repetitions.

In an example, during one or more first repetitions of the plurality of repetitions, the controller may control the one or more motors such that one or more first resistances, associated with the one or more first repetitions, are applied to the one or more exercise bars. The one or more first resistances may comprise a single resistance applied throughout the one or more first repetitions. Alternatively and/or additionally, the one or more first resistances may comprise multiple resistances applied based upon phases and/or portions of phases of the one or more first repetitions. Alternatively and/or additionally, during one or more second repetitions of the plurality of repetitions, the controller may control the one or more motors such that one or more second resistances, associated with the one or more second repetitions, are applied to the one or more exercise bars. In some embodiments, the one or more second resistances are different than the one or more first resistances.

In some embodiments, the controller may control the one or more motors such that the resistance applied to the one or more exercise bars varies over time. For example, the one or more resistance settings may be indicative of one or more resistance functions. A resistance function of the one or more resistance functions may correspond to an initial resistance, a last resistance and/or a rate of resistance change. For example, a first resistance function of the one or more resistance functions may be associated with a condition of the plurality of conditions, a phase of the first exercise process, a portion of a phase of the first exercise process, and/or a repetition of the exercise process.

For example, the controller may control the one or more motors based upon the first resistance function based upon a determination that the condition associated with the first resistance function is met. Alternatively and/or additionally, the controller may control the one or more motors based upon the first resistance function based upon a determination that the current phase of the first exercise process is the phase associated with the first resistance function. Alternatively and/or additionally, the controller may control the one or more motors based upon the first resistance function based upon a determination that the current portion of the current phase of the first exercise process is the portion of the phase associated with the first resistance function. Alternatively and/or additionally, the controller may control the one or more motors based upon the first resistance function based upon a determination that the current repetition of the first exercise process is the repetition associated with the first resistance function.

In some embodiments, when the controller controls the one or more motors based upon the first resistance function, the controller may initially control the one or more motors such that an initial resistance, associated with the first resistance function, is applied to the one or more exercise bars. The controller may then control the one or more motors such that the resistance applied to the one or more exercise bars increases and/or decreases at a rate of resistance change associated with the first resistance function. The rate of resistance change may be variable and/or constant. The rate of resistance change may correspond to a change of resistance over time (e.g., a decrease of 5 pounds per second or an increase of 5 pounds per second). Alternatively and/or additionally, the rate of resistance change may correspond to a change of resistance over position of the one or more exercise bars (e.g., a decrease of 5 pounds per inch that the one or more exercise bars are moved or an increase of 5 pounds per inch that the one or more exercise bars are moved).

In some embodiments, the controller may control the one or more motors such that the resistance applied to the one or more exercise bars increases and/or decreases (such as based upon the rate indicated by the first resistance function) until the resistance is equal to a last resistance associated with the first resistance function. In some embodiments, responsive to the resistance reaching the last resistance, the controller may control the one or more motors such that the last resistance is applied to the one or more exercise bars until at least one of the condition associated with the exercise function is no longer met, the phase associated with the first resistance function is completed, the portion of the phase associated with the first resistance function is completed, the repetition associated with the first resistance function is completed, etc.

Alternatively and/or additionally, the controller may control the one or more motors such that the resistance applied to the one or more exercise bars increases and/or decreases at the rate of resistance change until at least one of the condition associated with the exercise function is no longer met, the phase associated with the first resistance function is completed, the portion of the phase associated with the first resistance function is completed, the repetition associated with the first resistance function is completed, etc.

In some embodiments, the one or more resistance settings and/or other settings associated with the first exercise process may be user-input settings. In some embodiments, a first set of exercise settings associated with the first exercise process, such as at least one of the one or more resistance settings, a quantity of sets of the first exercise process, a quantity of repetitions of each set of the first exercise process, etc. may be received via an exercise interface of an interface device of the exercise machine. The exercise interface may comprise a graphical user interface displayed via a display of the interface device. For example, the exercise interface may comprise selectable inputs (e.g., selectable graphical objects and/or selectable text) corresponding to exercise settings. The first set of exercise settings may be selected via the exercise interface (such as via selections of one or more selectable inputs of the exercise interface). For example, the interface device may comprise a touchscreen and/or one or more other components for the user to interact with. Alternatively and/or additionally, the exercise interface may comprise at least one of a conversational interface, a voice interface, etc. such that the user may select settings and/or interact with the exercise interface via voice commands (e.g., the voice commands may be input via a microphone).

Alternatively and/or additionally, the first set of exercise settings may be received from a client device associated with the user (e.g., the client device may comprise at least one of a phone, a laptop, a smartphone, a tablet, a computer, a wearable computer such as a smart watch, a device that runs a virtual assistant, etc.). For example, a client exercise interface may be displayed via the client device. The first set of exercise settings may be selected via the client exercise interface (such as via selections of one or more selectable inputs of the client exercise interface). The client device may transmit settings information indicative of the first set of exercise settings to the controller, such as via a wireless connection and/or a wired connection. The controller may receive information (e.g., settings information, instructions and/or commands) from the client device via the wireless connection and/or the wired connection. In an example, the wired connection may be established via a wired connection (e.g., at least one of an Ethernet connection, a Fiber Channel connection, a Universal Serial Bus (USB) connection, etc.) from the controller to the client device and/or to a local area network. In an example, the wireless connection may be established via a wide area network, such as a public wide-area network (e.g., the Internet) and/or a private network (e.g., a virtual private network (VPN) of a distributed enterprise). Alternatively and/or additionally, the wireless connection may be established via a wireless network provided by a cellular provider (e.g., a second-generation cellular technology (2G) wireless network, a third-generation cellular technology (3G) wireless network, a fourth-generation cellular technology (4G) wireless network, a fifth-generation cellular technology (5G) wireless network, etc.). Alternatively and/or additionally, the wireless connection may be established via a wireless local area network at a location of the controller (e.g., a Wi-Fi network and/or a Bluetooth personal area network). Alternatively and/or additionally, the wireless connection may be established using Bluetooth Low Energy technology and/or Bluetooth mesh networking technology.

Alternatively and/or additionally, the first set of exercise settings may be received via a second client device associated with a different user, such as at least one of a fitness expert, a trainer, a physiotherapist, a medical professional, etc. For example, a second client exercise interface may be displayed via the second client device. The first set of exercise settings may be selected via the second client exercise interface (such as via selections of one or more selectable inputs of the second client exercise interface). The second client device may transmit settings information indicative of the first set of exercise settings to the controller, the first client device and/or to one or more servers (e.g., a cloud) associated with the exercise interface such as via a second wireless connection and/or a second wired connection.

In some embodiments, exercise information associated with the first exercise process may be determined. For example, the exercise information may comprise a quantity of sets of exercises performed in the first exercise process. Alternatively and/or additionally, the exercise information may comprise a quantity of repetitions for each set performed in the first exercise process. Alternatively and/or additionally, the exercise information may comprise one or more resistance levels associated with repetitions of the first exercise process. Alternatively and/or additionally, the exercise information may comprise at least one of a maximum resistance level used in the exercise process, a mean resistance level used in the exercise process, a median resistance level used in the exercise process, a mode resistance level used in the exercise process, a minimum resistance level used in the exercise process, etc. Alternatively and/or additionally, the exercise information may comprise one or more velocities associated with movement of the one or more exercise bars and/or movement of one or more body parts of the user. Alternatively and/or additionally, the exercise information may comprise at least one of a maximum velocity of the one or more velocities, a mean velocity of the one or more velocities, a median velocity of the one or more velocities, a mode velocity of the one or more velocities, a minimum velocity of the one or more velocities, etc. Alternatively and/or additionally, the exercise information may comprise one or more amounts of force applied by the user to the one or more exercise bars. Alternatively and/or additionally, the exercise information may comprise at least one of a maximum amount of force of the one or more amounts of force, a mean amount of force of the one or more amounts of force, a median amount of force of the one or more amounts of force, a mode amount of force of the one or more amounts of force, a minimum amount of force of the one or more amounts of force, etc. Alternatively and/or additionally, the exercise information may comprise an amount of calories burned by performing the first exercise process. Alternatively and/or additionally, the exercise information may comprise a rate at which the calories are burned. Alternatively and/or additionally, the exercise information may comprise an amount of energy produced in the first exercise process. Alternatively and/or additionally, the exercise information may comprise an amount of work performed and/or an amount of power applied in the exercise process. The amount of calories, the amount of work, the amount of energy and/or the amount of power may be determined based upon the quantity of sets, a quantity of repetitions for each set, one or more resistance levels associated with the first exercise process and/or one or more user parameters associated with the user. For example, the one or more user parameters may comprise body mass index (BMI) of the user, a height of the user and/or a weight of the user (and/or one or more other parameters, such as at least one of a measure of the user's body fat, a measure of the user's muscle, a measure of the user's metabolism, a measure of the user's bone density, etc.).

In some embodiments, the one or more user parameters may be received via the interface device, the client device associated with the user and/or the second client device. Alternatively and/or additionally, the one or more user parameters may be retrieved from a database of medical records associated with the user. Alternatively and/or additionally, the one or more user parameters may be determined based upon one or more signals received from one or more sensors, such as at least one of one or more optical sensors, one or more image sensors, one or more cameras, one or more weight sensors, etc. In an example, the height and/or the weight of the user may be determined based upon one or more images and/or one or more videos received from the one or more sensors, such as by performing one or more image processing techniques on the one or more images and/or the one or more videos. Alternatively and/or additionally, the weight of the user may be determined based upon an indication of the weight received from a weight sensor of the one or more sensors.

In some embodiments, the exercise information may be displayed via the interface device, the client device associated with the user and/or the second client device associated with the second user. Alternatively and/or additionally, the exercise information may be stored in a user profile associated with the user profile. In some embodiments, the user profile may comprise historical exercise information associated with the user, user parameters associated with the user (such as comprising the one or more user parameters and/or other user parameters, such as at least one of age, gender, etc.) and/or identification information associated with the user. In some embodiments, the identification information may comprise at least one of facial recognition information associated with the user, fingerprint information associated with the user, device identification information associated with the client device associated with the user, user account information associated with a user account of the user, etc.

In some embodiments, the user may be identified (and/or determined to be associated with the user profile) based upon the identification information. For example, prior to the first exercise process being performed (and/or during and/or after the first exercise process being performed) the user may be identified by the controller based upon login information input via the interface device and/or the client device. For example, it may be determined that the user is associated with the user account and/or the user profile based upon a determination that at least some of the login information matches the user account information associated with the user account. Alternatively and/or additionally, it may be determined that the user is associated with the user account and/or the user profile based upon a determination that the user matches the facial recognition information stored in the user profile (such as by analyzing one or more images of the user received from one or more sensors of the exercise machine using one or more facial recognition techniques). Alternatively and/or additionally, it may be determined that the user is associated with the user account and/or the user profile based upon a determination that a fingerprint of the user matches the fingerprint information stored in the user profile (such as by comparing fingerprint data received from one or more fingerprint sensors of the exercise machine with the fingerprint information). Alternatively and/or additionally, it may be determined that the user is associated with the user account and/or the user profile via communication between the controller and the client device of the user. The communication may be performed when the client device is within a threshold distance to the controller. The communication may be performed by the wireless connection (and/or a different wireless connection) and/or by a connection established via near-field communication (NFC). It may be determined that the user is associated with the user account and/or the user profile based upon a determination that the client device matches the device identification information of the user profile.

In some embodiments, responsive to identifying the user (e.g., determining that the user using the exercise machine is associated with the user account and/or the user profile), information of the user profile may be retrieved from one or more servers on which the user profile is stored (e.g., a cloud) and/or displayed via the interface device. Alternatively and/or additionally, the exercise information associated with the first exercise process may be stored in the user profile based upon the identification of the user (e.g., a determination that the user using the exercise machine and/or performing the first exercise process is associated with the user account and/or the user profile). In some embodiments, rather than storing the information of the user profile on the one or more servers, the user profile (and/or at least a portion of the user) may be stored on the client device, such as in accordance with one or more privacy preferences of the user to keep the user profile stored on the client device and/or not to store the user profile on the one or more servers. In some embodiments, information, such as the first set of exercise settings associated with the first exercise process, may be transmitted by the client device to the controller prior to performing the first exercise process. After the first exercise process is complete, the controller may transmit the exercise information associated with the first exercise process to the client device and/or the client device may store the exercise information in the user profile.

In some embodiments, information of the user profile may be accessed via the interface device and/or the client device. For example, the historical exercise information associated with previous exercise processes that the user performed using one or more exercise machines (comprising the exercise machine) may be accessed via the interface device (when it is determined that the user using the exercise machine is associated with the user account and/or the user profile) and/or the client device (such as by logging into the user account). In some embodiments, the historical exercise information displayed via the interface device and/or the client device may be indicative of at least one of sets performed in exercise processes, repetitions performed in exercise processes, resistance levels used in exercise processes, one or more velocities associated with movement of the one or more exercise bars, one or more velocities associated with movement of one or more body parts of the user in exercise processes, one or more amounts of force applied by the user on the one or more exercise bars in exercise processes, calories burned in exercise processes, amounts of work performed in exercise processes, amounts of power applied in exercise processes, amounts of energy produced in exercise processes, times at which exercise processes were performed, etc. For example, the information may be displayed in the form of a chart (e.g., at least one of a graph, a table, etc. may be generated based upon the information and/or displayed via the interface device and/or the client device). In some embodiments, the information may be displayed via the exercise interface.

Alternatively and/or additionally, at least a portion of information in the user profile may be accessed via the second client device (e.g., associated with at least one of a fitness expert, a trainer, a physiotherapist, a medical professional, etc. associated with the user) responsive to receiving authorization, from the client device and/or the interface device, to provide the second client device with access to the at least a portion of information. In some embodiments, the authorization may be received via an authorization message, such as comprising an indication of consent to provide the second client device with the at least a portion of information. Alternatively and/or additionally, the authorization message may be indicative of a scope of access, such as one or more types of information, of the user profile, to which access may be provided to the second client device. Merely information of the user profile within the scope of access may be accessed via the second client device (e.g., information corresponding to the one or more types of information may be transmitted to the second client device).

Alternatively and/or additionally, at least a portion of information in the user profile may be shared with other users responsive to receiving authorization, from the client device and/or the interface device, to provide user accounts and/or devices associated with the other users with access to the at least a portion of information. In some embodiments, the authorization may be received via an authorization message, such as comprising an indication of consent to provide the user accounts and/or the devices with the at least a portion of information. Alternatively and/or additionally, the authorization message may be indicative of a scope of access, such as one or more types of information, of the user profile, to which access may be provided to each user account of the user accounts and/or each device of the devices. Merely information of the user profile within the scope of access may be accessed via a user account of the user accounts and/or a device of the devices. In an example, the user accounts and/or the devices (and/or the users associated with the user accounts and/or the devices) may correspond to contacts of the user with which the user wants to share exercise information, such as to compare the user's performance with performance of other users. In some embodiments, the user may communicate with the user accounts and/or the devices (and/or the users associated with the user accounts and/or the devices) via a communication service, such a social media platform, an email service, a messaging service, a video calling service, a file sharing service, and/or other types of communication services. The communication service may be a part of an exercise service that provides the exercise interface and/or the client exercise interface. Alternatively and/or additionally, the communication service may be different than and/or separate from the exercise service. The authorization may be received via the communication service. The user accounts and/or the devices may access the at least a portion of information of the user profile via the communication service. In some embodiments, the authorization may include authorization to provide all of the user's contacts (e.g., contacts of the user that are saved on the client device and/or contacts with which the user communicates with via the communication service) with access to the at least a portion of information of the user profile. Alternatively and/or additionally, the authorization may include authorization to provide the public (e.g., user accounts and/or client devices with which the user is not connected) with access to the at least a portion of information of the user profile. Alternatively and/or additionally, the authorization may comprise an indication to block one or more contacts from accessing the at least a portion of information of the user profile. In some embodiments, the communication service may provide a competition interface to enable the user to compete with one or more of the user's contacts and/or other users, such as with respect to various performance indicators (e.g., at least one of calories burned, duration of exercise, quantities of sets and/or repetitions, resistance levels used while exercising, maximum amount of resistance level used during an exercise, etc.). In some embodiments, results of a competition (e.g., one or more rankings of one or more users that participated in a competition, such as ranked from most calories burned to least calories burned) may be shared amongst selected contacts (e.g., user accounts and/or client devices that are selected by the user via the client device) and/or may be shared publicly using various communication services.

In some embodiments, the exercise interface (on the interface device) and/or the client exercise interface (on the client device) may display one or more exercise options for performing exercise processes using the exercise machine. An exercise option of the one or more exercise options may correspond to a set of exercise settings for performing an exercise process. For example, the set of exercise settings may correspond to at least one of a quantity of sets of sets to be performed in the exercise process, a quantity of repetitions to be performed for each set, one or more trajectories of motion associated with performance of the exercise process, resistance settings (e.g., levels of resistance to be applied to the one or more exercise bars) associated with conditions, phases, sets and/or repetitions of the exercise process, etc.

In some embodiments, the one or more exercise options (and/or exercise settings associated with the one or more exercise options) may be generated based upon the historical exercise information associated with the user. For example, a capability and/or a performance of the user may be determined based upon at least one of resistance levels of historical exercise processes previously performed by the user, quantities of sets of the historical exercise processes, quantities of repetitions of the sets of the historical exercise processes, etc. For example, the capability and/or the performance of the user may be determined using one or more machine learning techniques and/or one or more artificial intelligence (AI) techniques. The one or more exercise options (and/or exercise settings associated with the one or more exercise options) may be generated based upon the capability and/or the performance of the user (and/or based upon historical exercise information of the user profile) such that the user is capable of performing the one or more exercise options. In some embodiments, the one or more exercise options may be generated using one or more machine learning techniques and/or one or more AI techniques.

Alternatively and/or additionally, the one or more exercise options (and/or exercise settings associated with the one or more exercise options) may be generated based upon one or more fitness goals associated with the user. In some embodiments, the user profile may be indicative of the one or more fitness goals. Indications of the one or more fitness goals may be received via the interface device, the client device and/or the second client device. Indications of the one or more fitness goals may be stored in the user profile responsive to determining the one or more fitness goals. In some embodiments, the one or more fitness goals may be selected from a plurality of fitness goals, such as at least one of maximum muscle growth, weight loss, fat loss, general endurance, body-building competition preparation, muscle activation, improved oxygen consumption (e.g., improved $VO_2$ max), improved heart rate, improved flexibility, improved muscle and/or body strength, improved athletic skills (such as specific to a sport), improved joint flexibility, etc.

In an example where an exercise option of the one or more exercise options is generated based upon the one or more fitness goals, the exercise option may be designed and/or generated (such as using one or more machine learning techniques and/or one or more AI techniques) by configuring at least one of one or more resistance settings of the exercise option, a quantity of sets of the exercise option, a quantity of repetitions of the sets of the exercise option, etc. to provide for improvement and/or progress with respect to the one or more fitness goals when an exercise process corresponding to the exercise option is performed.

In an example where the one or more fitness goals comprises at least one of maximum muscle growth, body-building competition preparation, muscle activation, improved muscle and/or body strength, etc., the one or more resistance settings of the exercise option may be configured such that a resistance applied by the one motors to the one or more exercise bars during an eccentric phase of the exercise process is greater than a resistance applied by the one or more motors to the one or more exercise bars during a concentric phase of the exercise process. In the example, the one or more resistance settings may be configured to maximize benefits of the exercise process and/or increase the efficiency of the exercise process in accordance with research showing that muscle builds at a higher rate in the eccentric phase of the exercise process as compared to the concentric phase of the exercise process.

In some embodiments, in a scenario where the one or more fitness goals comprises multiple fitness goals, each fitness goal of the multiple fitness goals may be associated with a weight value indicating an emphasis on the fitness goal. In an example, the one or more fitness goals may comprise a first fitness goal (e.g., weight loss) and/or a second fitness goal (e.g., general endurance). The one or more exercise options (and/or the exercise settings associated with the one or more exercise options) may be generated based upon the first fitness goal and/or the second fitness goal. In an example where a weight value associated with the first fitness goal is higher than a weight value associated with the second fitness goal, the one or more exercise options may be generated by placing more emphasis on the first fitness goal than the second fitness goal.

Alternatively and/or additionally, the one or more exercise options (and/or exercise settings associated with the one or more exercise options) may be generated based upon one or more target muscles associated with the user. For example, the one or more target muscles may correspond to specific muscles that the user wants to activate, strengthen, tone, work and/or condition when using the exercise machine to perform exercise processes. Indications of the one or more target muscles may be received via the interface device, the client device and/or the second client device. Indications of the one or more target muscles may be stored in the user profile.

In an example where an exercise option of the one or more exercise options is generated based upon the one or more target muscles, the exercise option may be designed and/or generated (such as using one or more machine learning techniques and/or one or more AI techniques) by configuring at least one of one or more resistance settings of the exercise option, a quantity of sets of the exercise option, a quantity of repetitions of the sets of the exercise option, etc. to provide for activating, strengthening, toning, working and/or conditioning the one or more target muscles when an exercise process corresponding to the exercise option is performed.

Alternatively and/or additionally, in a scenario where the one or more target muscles comprises multiple target muscles, each target muscle of the multiple target muscles may be associated with a weight value indicating an emphasis on the target muscles. In an example, the one or more target muscles may comprise a first target muscle (e.g., triceps) and/or a second target muscle (e.g., pectorals). The one or more exercise options (and/or the exercise settings associated with the one or more exercise options) may be generated based upon the first target muscle and/or the second target muscle. In an example where a weight value associated with the first target muscle is higher than a weight value associated with the second target muscle, the one or more exercise options may be generated by placing more emphasis on the first target muscle than the second target muscle.

Alternatively and/or additionally, the one or more exercise options (and/or exercise settings associated with the one or more exercise options) may be generated based upon one or more body conditions associated with the user. In an example, the one or more body conditions may correspond to at least one of tiredness, one or more damaged muscles, one or more damaged joints, pain at one or more locations of the user's body, one or more soft tissue injuries, cartilage damage, arthritis impacting one or more locations of the user's body, one or more physical impairments, etc. for which the user may be undergoing physical therapy. Indications of the one or more body conditions may be received via the interface device, the client device and/or the second client device. Indications of the one or more body conditions may be stored in the user profile.

In an example where an exercise option of the one or more exercise options is generated based upon the one or more body conditions, the exercise option may be designed and/or generated (such as using one or more machine learning techniques and/or one or more AI techniques) by configuring at least one of one or more resistance settings of the exercise option, a quantity of sets of the exercise option, a quantity of repetitions of the sets of the exercise option, etc. to provide for activating, strengthening, toning, working and/or conditioning one or more first muscles, one or more first joints and/or one or more first body parts when an exercise process corresponding to the exercise option is performed while avoiding pressure on and/or activation of one or more second muscles, one or more second joints, and/or one or more second body parts associated with the one or more body conditions.

In an example, the user may avoid performing one or more first exercises with over a threshold amount of resistance (e.g., the user may be unable to perform the one or more first exercises with over the threshold amount of resistance and/or performance of the one or more first exercises with over the threshold amount of resistance may be detrimental to the user due to the one or more body conditions) and/or the user may not avoid performing one or more second exercises with resistance (e.g., the user may be able to perform the one or more second exercises with resistance and/or performance of the one or more second exercises with resistance may be beneficial to the user). In some embodiments, the one or more resistance settings may be configured based upon the one or more body conditions such that a first resistance is applied by the one or more motors during a first portion of the exercise process and a second resistance is applied by the one or more motors during a second portion of the exercise process, where the first portion is associated with the one or more first exercises and/or the second portion is associated with the one or more second exercises. The first resistance may be lower than the second resistance (e.g., the first resistance may be zero and/or a resistance less than the threshold amount of resistance while the second resistance may be 30 pounds). In an example, the one or more first exercises may comprise flexion exercises and/or the one or more second exercises may comprise extension exercises. In the example, the first portion of the exercise process may comprise shoulder flexion and/or the second portion of the exercise process may comprise shoulder extension.

In some embodiments, guidance for the one or more exercise options, such as in relation to at least one of body positioning, posture, form, velocity, trajectory, etc., may be generated. For example, a set of exercise information associated with an exercise option of the one or more exercise options may be generated based upon at least one of the one or more fitness goals, the one or more target muscles, the one or more body conditions, etc. associated with the user. In some embodiments, the set of exercise information may indicate body posture, body form and/or body positioning of one or more body parts the user's body when the user performs an exercise process corresponding to the exercise option. For example, the set of exercise information may comprise one or more graphical objects, one or more videos, text and/or voice instructions indicating one or more body postures, one or more body forms and/or one or more body positions throughout various stages and/or phases of the exercise process. Alternatively and/or additionally, the set of exercise information may comprise one or more graphical objects, one or more videos, text and/or voice instructions indicating one or more locations of the user's body that the one or more exercise bars should be positioned on and/or adjacent to. Alternatively and/or additionally, the set of exercise information may comprise one or more graphical objects, one or more videos, text and/or voice instructions indicating one or more locations of the one or more exercise bars that should be interacted with by the user, such as gripped, grasped, etc. Alternatively and/or additionally, the set of exercise information may comprise one or more graphical objects, one or more videos, text and/or voice instructions indicating one or more velocities at which the user should move the one or more exercise bars at various stages and/or phases of the exercise process. Alternatively and/or additionally, the set of exercise information may comprise one or more graphical objects, one or more videos, text and/or voice instructions indicating one or more trajectories with which the user should move one or more of the user's body parts and/or the one or more exercise bars at various stages and/or phases of the exercise process. In some embodiments, at least one of the one or more body postures, the one or more body forms, the one or more body positions, the one or more locations of the user's body that the one or more exercise bars should be positioned on and/or adjacent to, the one or more locations of the one or more exercise bars that should be interacted with by the user, the one or more velocities at which the user should move the one or more exercise bars at various stages and/or phases of the exercise process, the one or more trajectories with which the user should move one or more of the user's body parts and/or the one or more exercise bars at various stages and/or phases of the exercise process, etc. may be generated and/or designed (such as using one or more machine learning techniques and/or one or more AI techniques) such that the exercise process corresponding to the exercise option provides for improvement and/or progress with respect to the one or more fitness goals associated with the user, provides for activating, strengthening, toning, working and/or conditioning the one or more target muscles associated with the user, and/or adheres to the one or more body conditions associated with the user.

In some embodiments, one or more nutritional plans associated with the user may be generated. For example, the one or more nutritional plans may comprise at least one of a number of calories to consume per day, a number of calories to consume prior to exercising, one or more foods to consume, one or more times of day to consume the one or more foods, etc. In some embodiments, the one or more nutritional plans may be generated (such as using one or more machine learning techniques and/or one or more AI techniques) based upon at least one of the one or more user parameters associated with the user, the historical exercise information associated with the user, the one or more fitness goals, the one or more target muscles, the one or more body conditions, etc.

In some embodiments, an exercise option of the one or more exercise options (and/or one or more exercise settings associated with the exercise option) may be modified and/or adjusted via the interface device and/or the client device (and/or the second client device). For example, at least one of one or more resistance settings associated with the exercise option, a quantity of sets associated with the exercise option, a quantity of repetitions associated with a set of the exercise option, etc. may be modified, such as using the exercise interface (on the interface device) and/or using the client exercise interface (on the client device). Alternatively and/or additionally, an exercise process configuration corresponding to an exercise process may be configured and/or generated using the interface device and/or the client device (and/or the second client device). For example, at least one of one or more resistance settings associated with the exercise process configuration, a quantity of sets associated with the exercise process configuration, a quantity of repetitions associated with one or more sets of the exercise process configuration, etc. may be configured and/or generated using the exercise interface (on the interface device) and/or using the client exercise interface (on the client device).

In some embodiments, information may be displayed while an exercise process is being performed by the user using the exercise machine. In some embodiments, the information may be displayed via the interface device and/or the client device while the exercise process is performed. In an example, the interface device may be positioned facing the user (such as when the user is performing the exercise process). In some embodiments, the information displayed via the interface device and/or the client device may comprise at least one of a quantity of sets of the exercise process that are completed, a quantity of sets of the exercise process that remain to be completed, a current set of the exercise process, a quantity of repetitions of the current set that are completed, a quantity of repetitions of the current set that remain to be completed, one or more resistance levels of one or more completed repetitions, a current resistance level, a next resistance level that will be applied after the current resistance level, one or more resistance levels of one or more repetitions that remain to be completed, an angle of tilt of an exercise bar of the one or more exercise bars with respect to a reference orientation of the exercise bar, etc. In some embodiments, the information may comprise a set of exercise information associated with guidance for the user to perform the exercise process. For example, the information may comprise one or more graphical objects and/or one or more videos showing at least one of body posture, body positioning, body form, velocity, trajectory of motion, etc. associated with the exercise process. Alternatively and/or additionally, the information may be output via a speaker of the exercise machine. It may be appreciated that displaying the information while the exercise process is performed, enables the user to monitor and/or be aware of various aspects of the exercise process that the user.

In some embodiments, a training video may be displayed while the exercise process is being performed by the user using the exercise machine. In some embodiments, the training video may be displayed via the interface device and/or the client device while the exercise process is performed. In some embodiments, the training video may be a real-time video (and/or a streaming video) received from a device associated with at least one of a fitness expert, a trainer, a physiotherapist, a medical professional, etc. associated with the user (e.g., the video may be received from the second client device). For example, at least one of the fitness expert, the trainer, the physiotherapist, the medical professional, etc. may at least one of speak with the user, demonstrate exercise techniques to the user, etc. in the real-time video. In some embodiments, a video of the user may be recorded using one or more sensors. The video of the user may be transmitted to the device and/or displayed via the device such that at least one of the fitness expert, the trainer, the physiotherapist, the medical professional, etc. may monitor and/or supervise the user performing the exercise process. Alternatively and/or additionally, the video of the user may be displayed via the interface device and/or the client device such that the user may view themselves performing the exercise process. The video may be displayed in real-time or near real-time (such as while the video is recorded) such that the user may view themselves performing the exercise process while performing the exercise process. In some embodiments, the user and at least one of the fitness expert, the trainer, the physiotherapist, the medical professional, etc. may communicate with each other during the exercise process. Alternatively and/or additionally, the training video may be a pre-recorded video associated with performing the exercise process.

In some embodiments, one or more signals received from one or more sensors may be analyzed and/or monitored during the exercise process. The one or more sensors may comprise at least one of one or more infrared sensors, one or more optical sensors, one or more cameras, one or more image sensors, one or more motion sensors, one or more electrocardiogram leads positioned on the user, one or more electromyograph devices comprising one or more electrodes positioned on the user, etc.

In some embodiments, motion capture and/or motion tracking may be performed using the one or more sensors to record, monitor and/or analyze one or more positions and/or one or more movements of at least one of the one or more exercise bars and/or one or more body parts of the user during the exercise process. In some embodiments, the motion capturing and/or the motion tracking may be performed using one or more videos and/or one or more images received from one or more optical sensors, one or more cameras and/or the one or more image sensors. Alternatively and/or additionally, the motion capturing and/or the motion tracking may be performed using one or more infrared signals received from the one or more infrared sensors. Alternatively and/or additionally, the motion capturing and/or the motion tracking may be performed using one or more motion signals received from the one or more motion sensors.

Performance information may be determined based upon the one or more videos, the one or more images the one or more infrared signals and/or the one or more motion signals received from the one or more sensors (such as using one or more machine learning techniques and/or one or more AI techniques). The performance information may be indicative of at least one of the one or more positions, one or more trajectories of the one or more movements, one or more velocities of the one or more movements, etc. In some embodiments, at least some of the performance information, such as the one or more trajectories of the one or more movements and/or the one or more velocities of the one or more movements may be determined via the motion capturing and/or the motion tracking. Alternatively and/or additionally, the performance information may be indicative of at least one of a body posture, a body positioning, a body form, etc. of the user during the exercise process. In some embodiments, representations of at least some of the performance information may be displayed via the interface device and/or the client device while the user performs the exercise process.

The performance information may be analyzed to determine whether the exercise process is being performed correctly. In an example, the performance information (e.g., at least one of the one or more positions, the one or more trajectories of the one or more movements, the one or more velocities of the one or more movements, the body posture, the body positioning, the body form, etc.) may be compared (such as using one or more machine learning techniques and/or one or more AI techniques) with correct performance information associated with correct performance of the exercise process (e.g., the correct performance information may be indicative of at least one of positions, trajectories of movement, velocities of movement, body postures, body positioning, body form, etc. associated with correct performance of the exercise process). It may be determined that the user is performing the exercise process incorrectly based upon a determination that the at least one of the one or more positions, the one or more trajectories of the one or more movements, the one or more velocities of the one or more movements, the body posture, the body positioning, the body form, etc. of the performance information are different than at least one of positions, trajectories of movement, velocities of movement, body postures, body positions, body forms, etc. indicated by the correct performance information.

Responsive to determining that the user is performing the exercise process incorrectly, the controller may inform the user of the incorrect performance, such as by outputting an incorrect performance message via the interface device, the speaker and/or the client device. It may be appreciated that informing the user of the incorrect performance enables the user to determine aspects of the exercise process that the user performed incorrectly, thus enabling the user to improve their performance and preventing an accident and/or an injury associated with the incorrect performance.

Alternatively and/or additionally, responsive to determining that the user is performing the exercise process incorrectly, information associated with correct performance of the exercise process may be displayed via the interface device and/or the client device and/or output via the speaker. For example, the information may comprise instructions and/or guidance for performing the exercise process correctly. For example, the information may comprise one or more graphical objects, one or more videos and/or one or more instructions indicating at least one of correct body posture, correct body positioning, correct body form, correct velocity, correct motion trajectory, etc. associated with the exercise process.

In some embodiments, the exercise machine may utilize a virtual reality (VR) system, an augmented reality (AR) system and/or a mixed reality (MR) system. For example, the VR system, the AR system and/or the MR system may be implemented via one or more devices, such as at least one of a VR headset, one or more displays, the interface device and/or the client device. Information (e.g., information associated with the exercise process, such as the performance information and/or information associated with correct performance of the exercise process) may be displayed and/or conveyed to the user via the one or more devices.

Alternatively and/or additionally, the information may comprise one or more differences between the performance of the exercise process by the user and correct performance of the exercise process. In an example where the user's hand placement is incorrect, the information may indicate that a location of the one or more exercise bars where the user's hand grips the one or more exercise bars is 5 inches to the left of where the user's hand should grip the one or more exercise bars. In an example where the user's posture is incorrect, the information may indicate that the user's back should be arched, rather than flat. It may be appreciated that outputting the information associated with the correct performance of the exercise process enables the user to learn how to perform aspects of the exercise process correctly, thus enabling the user to improve their performance and preventing an accident and/or an injury associated with the incorrect performance.

Alternatively and/or additionally, responsive to determining that the user is performing the exercise process incorrectly, the controller may perform the one or more safety operations described in the foregoing description. By performing the one or more safety operations, the exercise machine may prevent a potential injury that may occur as a result of the user performing the exercise process incorrectly.

Alternatively and/or additionally, responsive to determining that the user is performing the exercise process incorrectly, the controller may reduce the resistance applied by the one or more motors to the one or more exercise bars. For example, the user performing the exercise process incorrectly may be a result of a situation in which the user is not able to and/or is struggling to correctly perform the exercise process (e.g., lift the one or more exercise bars) due to the current resistance level. By reducing the resistance applied by the one or more motors, the exercise machine acts as a "spotter" in assisting the user to lift the one or more exercise bars, for example.

Figure 8A:
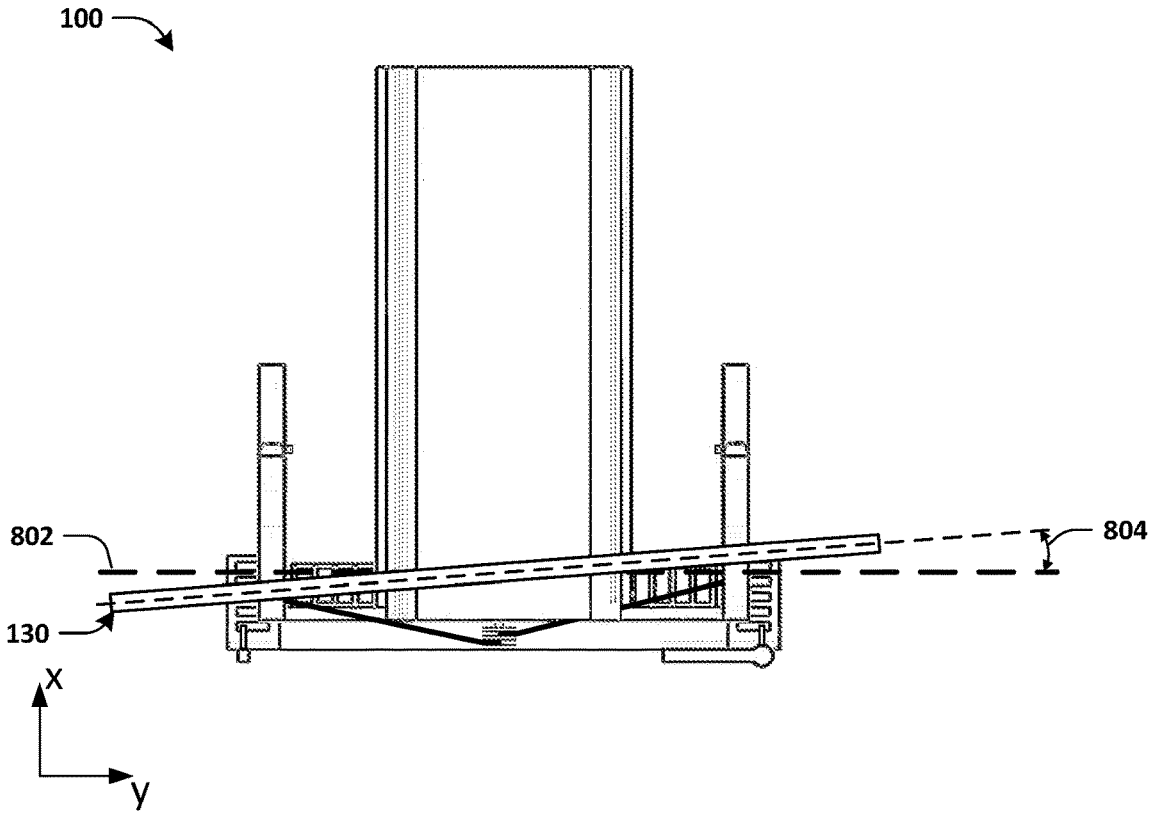
FIG. 8A illustrates determining whether an unsafe condition associated with an exercise machine is met, according to one exemplary embodiment.
Figure 8B:
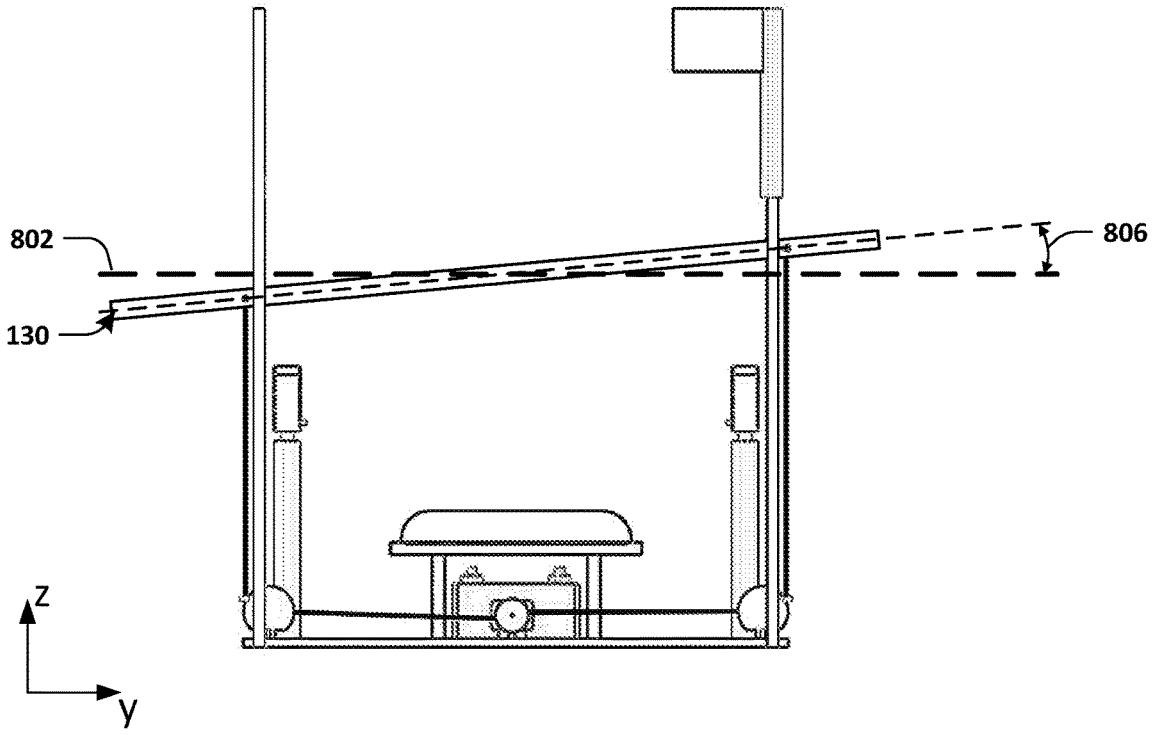
FIG. 8B illustrates determining whether an unsafe condition associated with an exercise machine is met, according to one exemplary embodiment.

In an example, an exercise bar of the one or more exercise bars may be at an angle with respect to a reference orientation (associated with correct performance of the exercise process) while the user is performing the exercise process (such as shown in FIGS. 8A-8B where a barbell 130 has an angle of tilt 804 and/or an angle of tilt 806 with respect to a reference orientation 802). In some embodiments, an angle of tilt of the exercise bar with respect to the reference orientation may be determined and/or analyzed, such as periodically and/or continuously, during the exercise process (such as using one or more of the techniques provided herein). In some embodiments, the angle of tilt may be displayed via the interface device and/or the client device during the exercise process. In some embodiments, it may be determined that the exercise process is being performed incorrectly based upon a determination that the angle of tilt exceeds a threshold angle of tilt. In some embodiments, responsive to determining that the angle of tilt exceeds the threshold angle of tilt, an indication of the angle of tilt exceeding the threshold angle of tilt and/or an instruction to maintain the exercise bar having the reference orientation in order to perform the exercise process correctly may be output via the interface device and/or the client device.

In some embodiments, heart rates, oxygen consumption (e.g., $VO_2$) and/or electrical activity of muscles of the user may be recorded, monitored and/or analyzed during the exercise process. In some embodiments, the heart rates may be recorded, monitored and/or analyzed using one or more signals, indicative of the heart rates, received from the one or more sensors (e.g., the one or more electrocardiogram leads and/or one or more other sensors). In some embodiments, the oxygen consumption may be recorded, monitored and/or analyzed using one or more signals, indicative of the oxygen consumption, received from the one or more sensors. In some embodiments, the electrical activity may be recorded, monitored and/or analyzed using one or more signals, indicative of the electrical activity, received from the one or more sensors (e.g., one or more electromyograph devices). For example, one or more electromyograms may be generated based upon the one or more signals indicative of the electrical activity.

In some embodiments, information indicative of the heart rates, the oxygen consumption and/or the electrical activity may be displayed via the interface device and/or the client device while the exercise process is being performed by the user using the exercise machine. Alternatively and/or additionally, the information may be output via the speaker. In some embodiments, the information may be determined and/or updated periodically and/or continuously, such as based upon signals received from the one or more sensors.

In some embodiments, the controller may control the one or more motors based upon at least one of the heart rates, the oxygen consumption and/or the electrical activity. For example, the heart rates, the oxygen consumption and/or the electrical activity may be analyzed to identify one or more abnormal characteristics. In some embodiments, responsive to determining that the heart rates, the oxygen consumption and/or the electrical activity have abnormal characteristics, the controller may perform the one or more safety operations described in the foregoing description. A determination that the heart rates, the oxygen consumption and/or the electrical activity have abnormal characteristics may correspond to a determination that the heart rates, the oxygen consumption and/or the electrical activity are different than (and/or have a threshold difference from) heart rates, measures of oxygen consumption (e.g., $VO_2$) and/or electrical activity recorded in previous exercise processes. Alternatively and/or additionally, a determination that the heart rates has abnormal characteristics may correspond to a determination that the heart rates exceeds a maximum heart rate and/or is less than a minimum heart rate. It may be appreciated that performing the one or more safety operations responsive to detecting one or more abnormal characteristics may prevent accidents and/or injuries of the user, and thus improve safety associated with using the exercise machine. Alternatively and/or additionally, the controller may perform the one or more safety operations responsive to a determination that the heart rates, the oxygen consumption and/or the electrical activity exceed than a heart rate threshold, an oxygen consumption threshold, and/or an electrical activity threshold, respectively. Alternatively and/or additionally, the controller may perform the one or more safety operations responsive to a determination that the heart rates, the oxygen consumption and/or the electrical activity are less than a heart rate threshold, an oxygen consumption threshold, and/or an electrical activity threshold, respectively.

In some embodiments, the controller may control resistance applied by the one or more motors to the one or more exercise bars based upon at least one of the heart rates, the oxygen consumption, the electrical activity, the one or more positions, one or more trajectories of one or more movements, the one or more velocities of the one or more movements, body posture, body positioning, body form, an angle of tilt of an exercise bar with respect to a reference orientation of the exercise bar, a velocity of the exercise bar, an acceleration of the exercise bar, etc. For example, during the exercise process, the controller may automatically increase and/or decrease the resistance applied by the one or more motors to the one or more exercise bars.

In some embodiments, responsive to determining that the velocity of the exercise bar and/or the one or more velocities of the one or more movements are less than a threshold velocity, the controller may reduce the resistance applied by the one or more motors to the one or more exercise bars. For example, the velocity of the exercise bars and/or the one or more velocities of the one or more movements being less than the threshold velocity may be a result of a situation in which the user performing the exercise process is not able to and/or is struggling to correctly perform the exercise process (e.g., lift the one or more exercise bars) at the current resistance level. By reducing the resistance applied by the one or more motors, the exercise machine acts as a "spotter" in assisting the user to lift the one or more exercise bars, for example.

Alternatively and/or additionally, responsive to determining that the angle of tilt of the exercise bar with respect to the reference orientation of the exercise bar exceeds a threshold angle of tilt, the controller may reduce the resistance applied by the one or more motors to the one or more exercise bars. For example, the angle of tilt of the exercise bar with respect to the reference orientation exceeding the threshold angle of tilt may be a result of a situation in which the user performing the exercise process is not able to and/or is struggling to correctly perform the exercise process (e.g., lift the one or more exercise bars) at the current resistance level.

In some embodiments, the controller may automatically increase the resistance applied to the one or more exercise bars based upon at least one of the electrical activity, the one or more trajectories of one or more movements, the one or more velocities of the one or more movements, the angle of tilt of the exercise bar with respect to the reference orientation of the exercise bar, the velocity of the exercise bar, the acceleration of the exercise bar, etc. For example, at least one of the electrical activity, the one or more trajectories of one or more movements, the one or more velocities of the one or more movements, the angle of tilt of the exercise bar with respect to the reference orientation of the exercise bar, the velocity of the exercise bar, the acceleration of the exercise bar, etc. may be analyzed to determine a performance level and/or a muscle strength associated with the user. In some embodiments, the controller may automatically increase the resistance applied to the one or more exercise bars responsive to determining, based upon the performance level and/or the muscle strength, that the user is capable of performing the exercise process with a greater resistance than the current resistance level.

In some embodiments, the controller may control resistance applied by the one or more motors to the one or more exercise bars based upon one or more commands. For example, a command of the one or more commands may correspond to a command to at least one of reduce the resistance applied by the one or more motors, increase the resistance applied by the one or more motors, stop the one or more motors from applying the resistance to the one or more exercise bars, disconnect the one or more motors from one or more components (e.g., the one or more components may comprise at least one of the controller, a power source with which the one or more motors are powered, one or more driving elements used for applying force to the one or more exercise bars, etc.), etc.

In some embodiments, the command may be received via at least one of the interface device, the client device, etc. In some embodiments, the command may correspond to a selection of a selectable input. Alternatively and/or additionally, the command may correspond to a voice command, such as received via a microphone (e.g., a microphone of the exercise machine and/or a microphone of the client device and/or a different device). In some embodiments, the command may be indicative of a resistance to be applied. For example, responsive to receiving the command, the controller may set the resistance applied by the one or more motors to the resistance indicated in the command. Alternatively and/or additionally, the command may be indicative of a change in resistance (e.g., an increase of 5 pounds or a reduction of 5 pounds). For example, responsive to receiving the command, the controller may set the resistance applied by the one or more motors to a resistance determined based upon a current resistance applied by the one or more motors and the change in resistance. In an example where the current resistance applied by the one or more motors is 50 pounds and/or the change in resistance is an increase of 5 pounds, the controller may set the resistance to 55 pounds responsive to receiving the command. In some embodiments, the command may correspond to a voice command comprising a term (e.g., a phrase and/or a word). The term may correspond to a user-selected term and/or a default term used to signal the controller to stop the one or more motors from applying resistance to the one or more exercise bars and/or to disconnect the one or more motors from one or more components, such as at least one of the controller, a power source with which the one or more motors are powered, one or more driving elements used for applying force to the one or more exercise bars, etc. Responsive to detecting the voice command indicating the term (e.g., responsive to the user and/or a different user stating the term), the controller may stop the one or more motors from applying resistance to the one or more exercise bars and/or the controller may disconnect the one or more motors from the one or more components.

In some embodiments, measures of at least one of the heart rates of the user during the exercise process, the oxygen consumption of the user during the exercise process, the electrical activity of the user during the exercise process, etc. may be stored in the user profile. Alternatively and/or additionally, performance information determined during the exercise process (e.g., at least one of one or more positions, one or more trajectories of one or more movements, one or more velocities of the one or more movements, body posture, body positioning, body form, etc. determined throughout the exercise process) may be stored in the user profile. Alternatively and/or additionally, indications of the performance information and/or the measures may be displayed via the interface device and/or the client device, such as during the exercise process and/or after the exercise process is performed and/or completed. In some embodiments, at least one of a maximum heart rate of the measures, a mean heart rate of the measures, a median heart rate of the measures, a mode heart rate of the measures, a minimum heart rate of the measures, a maximum oxygen consumption of the measures, a mean oxygen consumption of the measures, a median oxygen consumption of the measures, a mode oxygen consumption of the measures, a minimum oxygen consumption of the measures, etc. may be displayed via the interface device and/or the client device.

In some embodiments, improvement information may be generated based upon the motion information (such as using one or more machine learning techniques and/or one or more AI techniques). The improvement information may comprise indications of suggested changes to performance of the exercise process that may improve the user's performance, such as changes to at least one of body posture of the user during the exercise process, changes to body positioning of the user during the exercise process, changes to body form of the user during the exercise process, changes to the velocity with which the user moves one or more body parts and/or the one or more exercise bars during the exercise process, changes to a motion trajectory with which the user moves one or more body parts and/or the one or more exercise bars during the exercise process, etc. Alternatively and/or additionally, the improvement information may comprise indications of incorrect performance of the exercise process by the user. For example, the improvement information may comprise one or more graphical objects and/or description indicating aspects of the exercise process that the user performed incorrectly, such as at least one of incorrect posture, incorrect body positioning, incorrect body form, incorrect velocity, incorrect motion trajectory, etc. Alternatively and/or additionally, the improvement information may comprise indications (e.g., one or more graphical objects and/or descriptions) of correct performance of those aspects of the exercise process that the user performed incorrectly. It may be appreciated that providing the improvement information to the user enables the user to determine aspects of the exercise process that the user performed incorrectly and/or how to perform those aspects correctly, thus enabling the user to improve their performance and/or reducing the risk of an injury and/or an accident associated with incorrect performance of the exercise process.

In some embodiments, the historical exercise information of the user profile associated with the user may comprise at least one of heart rates associated with exercise processes performed by the user, measures of oxygen consumption associated with exercise processes performed by the user, indications of electrical activity of the user associated with exercise processes performed by the user, etc. Alternatively and/or additionally, the historical exercise information of the user profile may comprise sets of performance information associated with exercise processes performed by the user (e.g., a set of performance information may comprise at least one of one or more positions, one or more trajectories of one or more movements, one or more velocities of the one or more movements, body posture, body positioning, body form, etc. associated with an exercise process). In some embodiments, the one or more exercise options (and/or exercise settings associated with the one or more exercise options) may be generated (such as using one or more machine learning techniques and/or one or more AI techniques) based upon at least one of the heart rates associated with exercise processes performed by the user, the measures of oxygen consumption associated with exercise processes performed by the user, the indications of electrical activity of the user associated with exercise processes performed by the user, the sets of performance information associated with exercise processes performed by the user, etc.

In some embodiments, information comprising at least some of the historical exercise information of the user profile (such as at least one of heart rates, measures of oxygen consumption, electrical activity, etc.) and/or other information of the user profile may be shared with a medical system associated with a medical service (e.g., associated with at least one of a fitness expert, a trainer, a physiotherapist, a medical professional, etc. associated with the user) responsive to receiving authorization, from the client device and/or the interface device, to provide the medical system with access to the information. In some embodiments, the information may be used for medical purposes, such as at least one of developing a physical therapy plan for the user, monitoring a physical condition of the user while the user is undergoing treatment for a medical condition, monitoring progress of the user's performance and/or health over time, etc.

Figure 2:
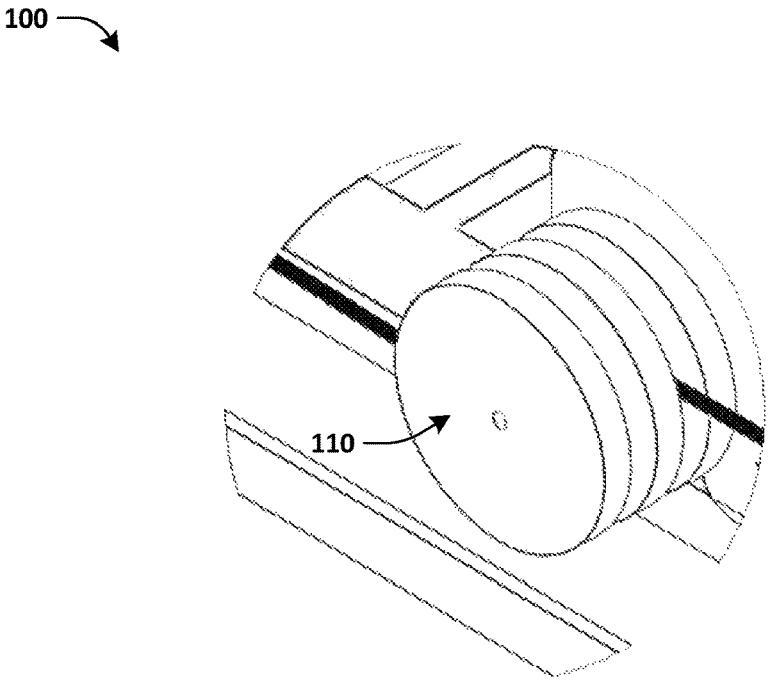
FIG. 2 is an illustration of an enlarged view of a driving component of an exercise machine, according to one exemplary embodiment.
Figure 3:
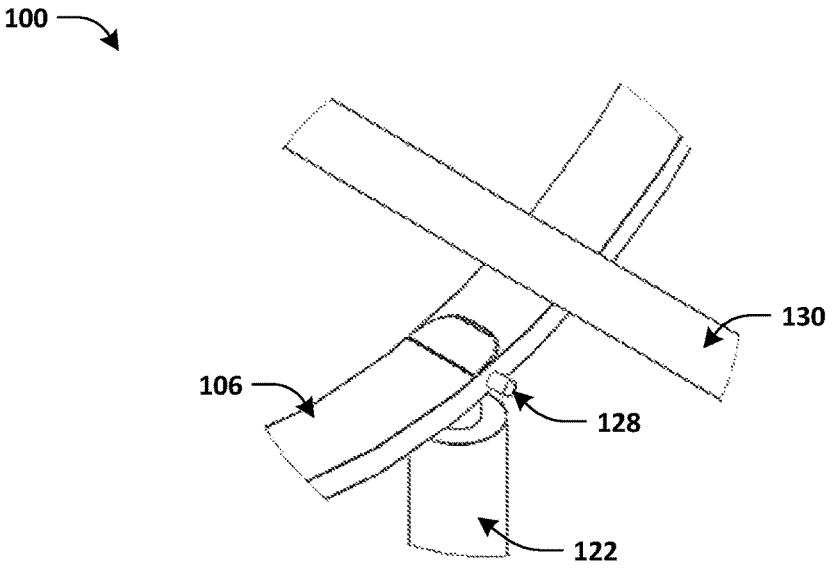
FIG. 3 is an illustration of an enlarged view of a first component of an exercise machine, according to one exemplary embodiment.
Figure 4:
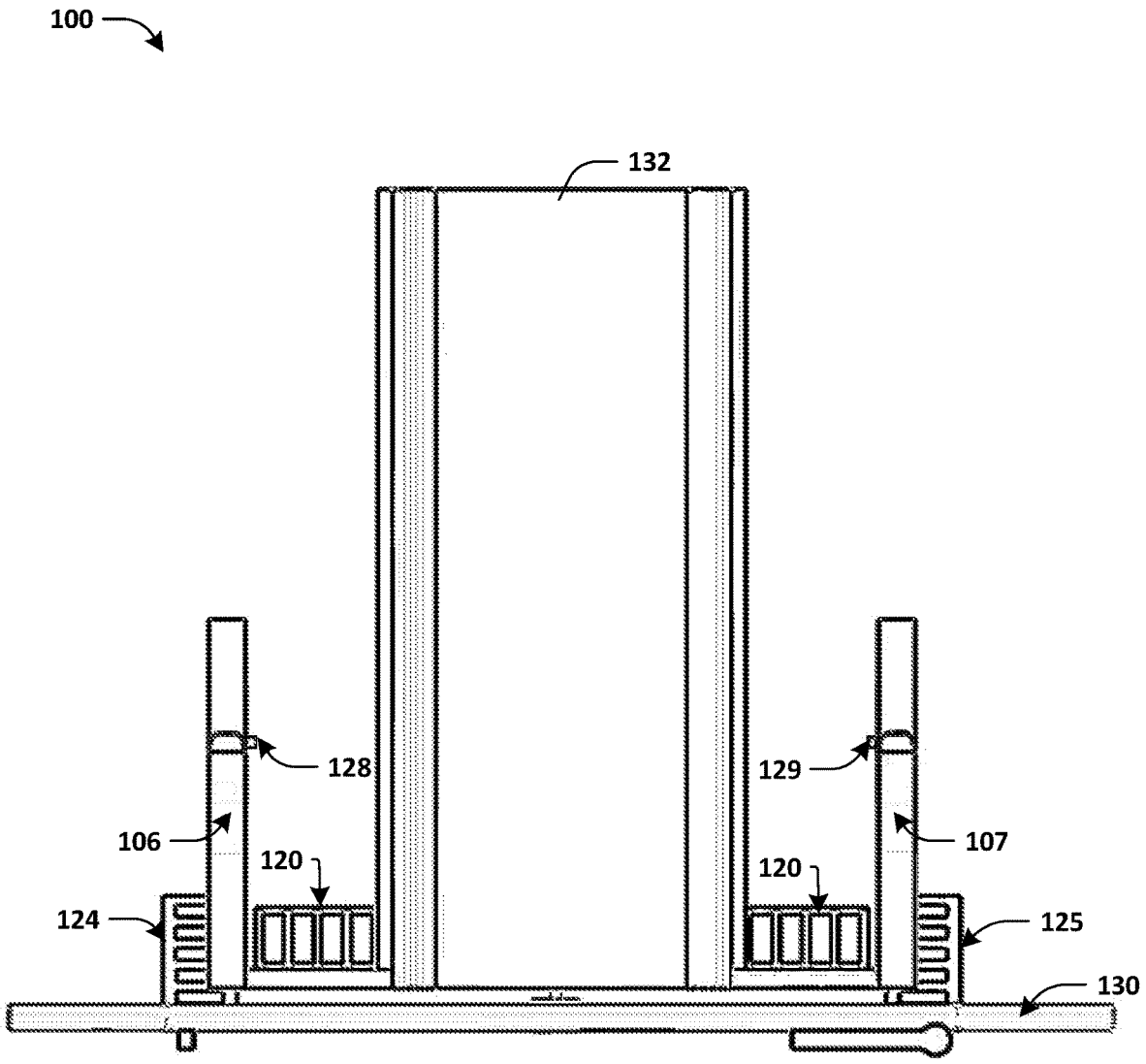
FIG. 4 is an illustration of a top view of an exercise machine, according to one exemplary embodiment.
Figure 5:
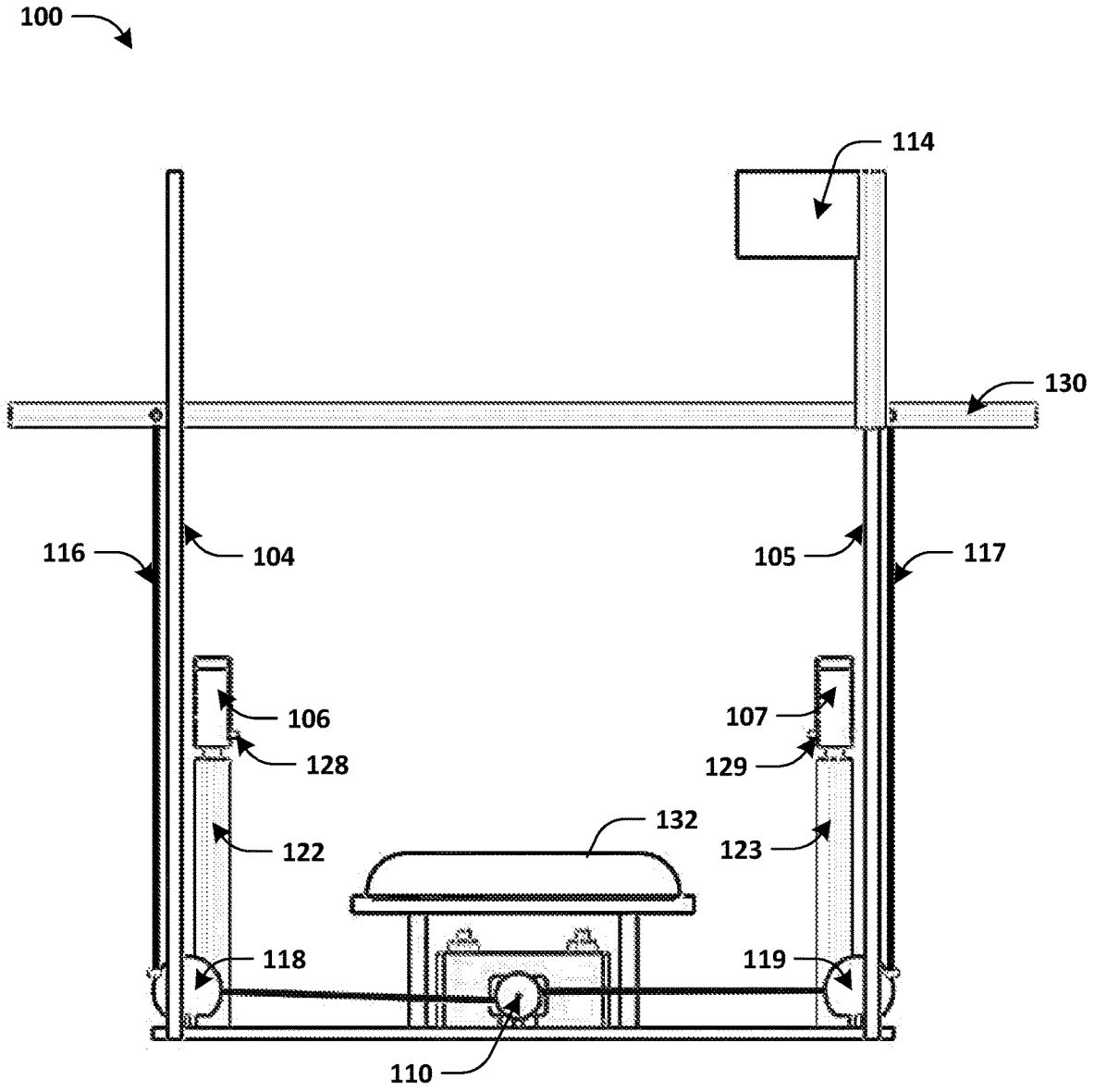
FIG. 5 is an illustration of a back view of an exercise machine, according to one exemplary embodiment.
Figure 6:
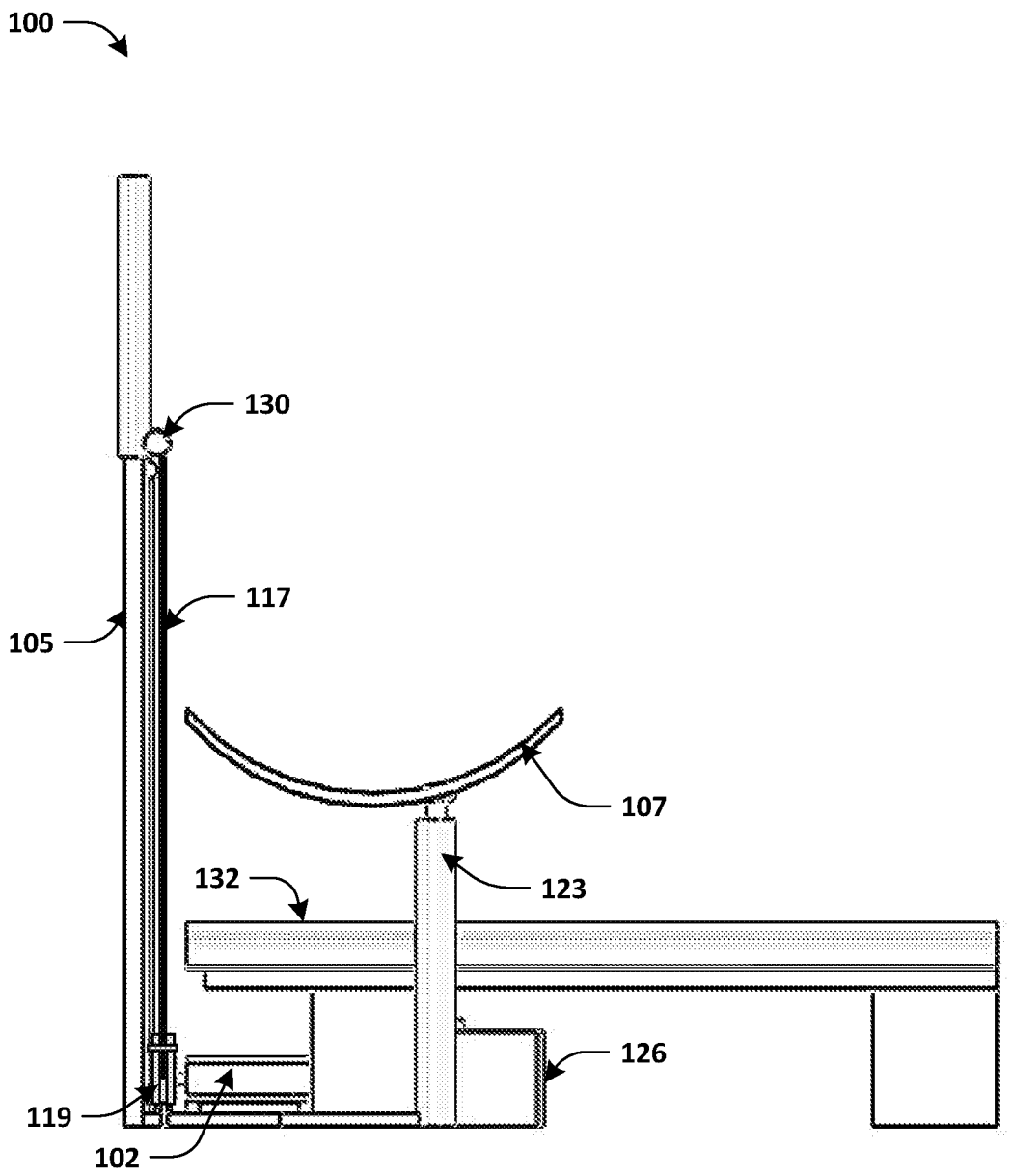
FIG. 6 is an illustration of a side view of an exercise machine, according to one exemplary embodiment.

One or more exemplary embodiments of the exercise machine are illustrated in FIGS. 1-9. FIGS. 1-9 illustrate an exercise machine 100. FIG. 1 illustrates a perspective view of the exercise machine 100. FIG. 2 illustrates an enlarged view of a driving component 110 of the exercise machine 100. FIG. 3 illustrates an enlarged view of a first component 128 of the exercise machine 100. FIG. 4 illustrates a top view of the exercise machine 100. FIG. 5 illustrates a back view of the exercise machine 100. FIG. 6 illustrates a side view of the exercise machine 100.

In some embodiments, the exercise machine 100 comprises a bench 132 and/or a seat (shown in FIG. 1 and FIGS. 4-6), a barbell 130 (shown in FIG. 1 and FIGS. 3-6), a barbell support structure, a driving mechanism coupled to the barbell 130, a motor 102 (shown in FIG. 1 and FIG. 6) coupled to the driving mechanism and/or a controller 155 (shown in FIG. 1). In some embodiments, the exercise machine 100 is a press machine (e.g., at least one of a bench press machine, a shoulder press machine, etc.) and/or a different type of exercise machine.

In some embodiments, the barbell support structure is configured to support the barbell 130, such as when the exercise machine 100 is not in use. In some embodiments, the barbell support structure comprises a first barbell support component 104 (shown in FIG. 1 and FIG. 5) (e.g., a first barbell pole) and/or a second barbell support component 105 (shown in FIG. 1 and FIGS. 5-6) (e.g., a second barbell pole) configured to support the barbell 130. The first barbell support component 104 and/or the second barbell support component 105 may extend vertically. In some embodiments, the first barbell support component 104 and/or the second barbell support component 105 may each comprise a holding structure configured to hold and/or maintain a position of the barbell 130 (e.g., the holding structure may correspond to a j-cup and/or a different type of holding structure), such as when the barbell 130 is not being moved by a user. In some embodiments, at least a portion of the first barbell component 104 and/or the second barbell component 105 may be at a higher elevation than a top side of the bench 132.

In some embodiments, the motor 102 may be an electric motor. Alternatively and/or additionally, the motor 102 may be a different type of motor. In some embodiments, the motor 102 is configured to generate one or more forces and/or apply the one or more forces to the barbell 130 via the driving mechanism. For example, the driving mechanism may comprise one or more driving elements, one or more pulleys, and/or one or more other power transfer components configured to transfer force generated by the motor 102 to the barbell 130. In some embodiments, the controller is configured to control the motor 102, such as control the one or more forces of the motor 102, based upon one or more inputs.

In some embodiments, the driving mechanism comprises a first pulley 118 (shown in FIG. 1 and FIG. 5), a second pulley 119 (shown in FIG. 1 and FIGS. 5-6), a first driving element 116 (shown in FIG. 1 and FIG. 5) and/or a second driving element 117 (shown in FIG. 1 and FIGS. 5-6). In some embodiments, the first driving element 116 comprises a first cable (e.g., a round cable having a round cross-sectional profile, a flat cable having a rectangular cross-sectional profile, a toothed cable, and/or a different type of cable), a first rope, a first belt (e.g., a round belt having a round cross-sectional profile, a flat belt having a rectangular cross-sectional profile, a toothed belt, and/or a different type of belt) and/or a first chain. In some embodiments, the second driving element 117 comprises a second cable (e.g., a round cable having a round cross-sectional profile, a flat cable having a rectangular cross-sectional profile, a toothed cable, and/or a different type of cable), a second rope, a second belt (e.g., a round belt having a round cross-sectional profile, a flat belt having a rectangular cross-sectional profile, a toothed belt, and/or a different type of belt) and/or a second chain.

In some embodiments, the first driving element 116 may be coupled to the motor 102 via a driving component 110 (shown in FIGS. 1-2 and FIG. 5). Alternatively and/or additionally, the second driving element 117 may be coupled to the motor 102 via the driving component 110. In some embodiments, the driving component 110 comprises a pulley (e.g., a driving pulley). Alternatively and/or additionally, the driving component 110 may comprise a double-pulley (e.g., a side-by-side double-pulley). For example, the first driving element 116 may be coupled to one pulley of the driving component 110 and/or the second driving element 117 may be coupled to another pulley of the driving component 110. It may be appreciated that rather than both the first driving element 116 and the second driving element 117 being coupled to the motor 102 via the driving component 110, two or more motors may be provided and the first driving element 116 can be connected to one motor of the two or more motors via a driving component of the one motor and the second driving element 117 can be connected to another motor of the two or more motors via a driving component of the other motor.

In some embodiments, the first driving element 116 may be coupled (e.g., affixed and/or fixedly coupled) to the driving component 110 at a first part (e.g., a first end) of the first driving element 116 and/or the first driving element 116 may be coupled (e.g., affixed and/or fixedly coupled) to the barbell 130 at a second part (e.g., a second end opposite the first end) of the first driving element 116. In an example, the second part of the first driving element 116 may be looped around a portion of the barbell 130. Alternatively and/or additionally, the second part of the first driving element 116 may be looped through a hole in the barbell 130. Alternatively and/or additionally, the second part of the first driving element 116 may be coupled to the barbell 130 using other configurations. In some embodiments, the second driving element 117 may be coupled (e.g., affixed and/or fixedly coupled) to the driving component 110 at a first part (e.g., a first end) of the second driving element 117 and/or the second driving element 117 may be coupled (e.g., affixed and/or fixedly coupled) to the barbell 130 at a second part (e.g., a second end opposite the first end) of the second driving element 117. In an example, the second part of the second driving element 117 may be looped around a portion of the barbell 130. Alternatively and/or additionally, the second part of the second driving element 117 may be looped through a hole in the barbell 130. Alternatively and/or additionally, the second part of the second driving element 117 may be coupled to the barbell 130 using other configurations.

In some embodiments, the first driving element 116 may be coupled to the first pulley 118. For example, the first pulley 118 may comprise a surrounding groove through at least part of which the first driving element 116 is positioned and/or passes through. In some embodiments, the first pulley 118 may be rotatable along a vertical axis of the first pulley 118, such as up to about a quarter revolution (and/or up to about a half revolution or a different revolution). In some embodiments, the first pulley 118 is positioned such that force applied by the motor 102 to the barbell 130 is in a desired direction. For example, the first pulley 118 may be positioned such that at least a portion of the first pulley 118 underlies a first portion of the barbell 130 to which the first driving element 116 is coupled. In some embodiments, by positioning the first pulley 118 such that at least a portion of the first pulley 118 underlies the first portion of the barbell 130, a force applied by the motor 102 to the first portion of the barbell 130 via the first driving element 116 is in the desired direction, such as vertically downwards.

In some embodiments, the second driving element 117 may be coupled to the second pulley 119. For example, the second pulley 119 may comprise a surrounding groove through at least part of which the second driving element 117 is positioned and/or passes through. In some embodiments, the second pulley 119 may be rotatable along a vertical axis of the second pulley 119, such as up to about a quarter revolution (and/or up to about a half revolution or a different revolution). In some embodiments, the second pulley 119 is positioned such that force applied by the motor 102 to the barbell 130 is in a desired direction. For example, the second pulley 119 may be positioned such that at least a portion of the second pulley 119 underlies a second portion of the barbell 130 to which the second driving element 117 is coupled. In some embodiments, by positioning the second pulley 119 such that at least a portion of the second pulley 119 underlies the second portion of the barbell 130, a force applied by the motor 102 to the second portion of the barbell 130 via the second driving element 117 is in the desired direction, such as vertically downwards. In some embodiments, a net force applied by the motor 102 to the barbell 130 via the first driving element 116 and/or the second driving element 117 is in the desired direction, such as vertically downwards.

In some embodiments, a user may perform a first exercise process using the exercise machine 100. In some embodiments, the first exercise process may correspond to at least one of bench press, incline press, decline bench press, military press, shoulder press, squat lift, etc. In some embodiments, the exercise machine 100 may be adjustable such that the user can use the exercise machine 100 for a plurality of types of exercise. For example, the user may adjust the bench 132 for a desired exercise (e.g., an angle of tilt of the bench 132 and/or an elevation of the bench 132 may be adjusted to perform the desired exercise, such as at least one of bench press, incline press, decline bench press, military press, shoulder press, etc.). Alternatively and/or additionally, the exercise machine 100 may comprise a seat, such as a seat comprising a seat back for back support. For example, the bench 132 may be replaced with the seat for use in one or more exercises such as shoulder press and/or other exercises. Alternatively and/or additionally, the exercise machine 100 may be used for performing squat exercises. For example, the exercise machine 100 may not comprise the bench 132 and/or the seat (and/or the bench 132 and/or the seat may be removed and/or moved to a different location) such that the user may perform a squat lift exercise using the exercise machine 100.

The user may lift the barbell 130 off of the barbell support structure. The user may perform the first exercise process by moving the barbell 130 in accordance with the desired exercise, such as by lowering the barbell 130 (e.g., downwards and/or in a different direction) and/or by pressing and/or lifting the barbell 130 (e.g., upwards and/or in a different direction). In some embodiments, a repetition of the first exercise process may comprise an eccentric phase (e.g., the lowering of the barbell 130 by the user), a concentric phase (e.g., the pressing and/or the lifting the barbell 130 by the user) and/or an isometric phase (e.g., a phase between the eccentric phase and the concentric phase where the barbell 130 is not moved and/or the barbell 130 has less than a threshold amount of movement, such as the user supporting the barbell 130 at arm's length after the concentric phase and/or the user supporting the barbell 130 on and/or over the user's chest after the eccentric phase).

In some embodiments, the exercise machine 100 may comprise one or more first sensors. The one or more first sensors may be used for measuring and/or determining one or more parameters associated with the first exercise process. For example, the one or more first sensors may be configured to detect first information, such as a position of the barbell 130, a direction of motion of the barbell 130, a velocity of the barbell 130, an acceleration of the barbell 130 and/or one or more other parameters. In some embodiments, the position may be indicative of one or more of a position in space of the barbell 130 at a current time (e.g., the position may comprise coordinates specifying a location of the barbell 130 in three-dimensional space and/or one or more distances between the barbell 130 and one or more reference locations) and/or an orientation of the barbell 130 at the current time (e.g., one or more angles of tilt of the barbell 130 with respect to one or more reference orientations).

In some embodiments, the one or more first sensors may comprise at least one of one or more accelerometers, one or more proximity sensors, one or more optical sensors, one or more image sensors, one or more cameras, one or more motion sensors, one or more ultrasonic sensors, one or more infrared sensors, one or more load sensors, etc. configured to determine the first information using one or more of the techniques provided herein, such as in the foregoing description. In some embodiments, a sensor of the one or more first sensors may be positioned on the barbell 130 (e.g., the sensor may be coupled, such as affixed and/or fixedly coupled, to the barbell 130). Alternatively and/or additionally, a sensor of the one or more first sensors may be positioned away from the barbell 130, such as positioned on an object different than the barbell 130).

In an example, a sensor (e.g., a camera, an image sensor and/or an optical sensor) may be used to capture one or more images and/or one or more videos (comprising a representation of the barbell 130) at various times and/or at least some of the first information associated with the barbell 130 may be determined by performing one or more image processing techniques on the one or more images and/or the one or more videos.

In an example, a sensor (e.g., a proximity sensor and/or an ultrasonic sensor) positioned on an object different than the barbell 130 may be used for measuring one or more distances between the sensor and one or more portions of the barbell 130. At least some of the first information may be determined based upon measurements of the sensor, such as by performing one or more operations (e.g., one or more mathematical operations) using the one or more distances and/or other distances measured by the sensor at various times.

Alternatively and/or additionally, a sensor (e.g., a proximity sensor and/or an ultrasonic sensor) positioned on the barbell 130 may be used for measuring a distance between the sensor and a reference location, such as a location of a different sensor and/or a location of an object. At least some of the first information may be determined based upon measurements of the sensor, such as by performing one or more operations (e.g., one or more mathematical operations) using the distance and/or other distances measured by the sensor at various times.

In some embodiments, the one or more first sensors may be configured to transmit one or more signals to the controller. In some embodiments, the one or more signals may be transmitted continuously and/or periodically while the exercise machine 100 is in use (e.g., during the first exercise process) and/or outside of times that the exercise machine 100 is in use. The one or more signals may be indicative of the first information. For example, the one or more signals may comprise values corresponding to a position of the barbell 130, a direction of motion of the barbell 130, a velocity of the barbell 130, an acceleration of the barbell 130 and/or one or more other parameters associated with the barbell 130. Alternatively and/or additionally, the one or more signals may comprise measurements and/or other information (e.g., one or more distances, one or more other measured values, one or more images, etc.) from which at least some of the first information may be derived.

In some embodiments, the one or more inputs, based upon which the controller is configured to control the one or more motors, comprises the one or more signals. The first information may be determined based upon the one or more signals. In some embodiments, the controller may monitor and/or record values corresponding to one or more positions of the barbell 130, one or more directions of motion of the barbell 130, one or more velocities of the barbell 130, one or more accelerations of the barbell 130 and/or one or more other parameters. In some embodiments, the values may be determined and/or analyzed periodically (e.g., at a rate of at least one of 10 times per second, once per second, 10 times per minute, once per minute, etc.).

In some embodiments, the controller may control the one or more motors, such as the amount of force applied by the one or more motors on the barbell 130, based upon the values. For example, a first set of values may be compared with one or more safety parameters to determine whether an unsafe condition is met. The first set of values may comprise one or more values indicative of one or more measured positions of the barbell 130, one or more values indicative of one or more measured directions of motion of the barbell 130, one or more values indicative of one or more measured velocities of the barbell 130 and/or one or more values indicative of one or more measured accelerations of the barbell 130.

The one or more safety parameters may be indicative of one or more first positional parameters associated with safe operation of the exercise machine 100 (and/or safe usage of the exercise machine 100) and/or one or more second positional parameters associated with unsafe operation of the exercise machine 100 (and/or unsafe usage of the exercise machine 100). In some embodiments, one or more positional values of the first set of values may be compared with the one or more first positional parameters and/or the one or more second positional parameters to determine whether an unsafe condition is met, such as using one or more other techniques provided herein.

Figure 7:
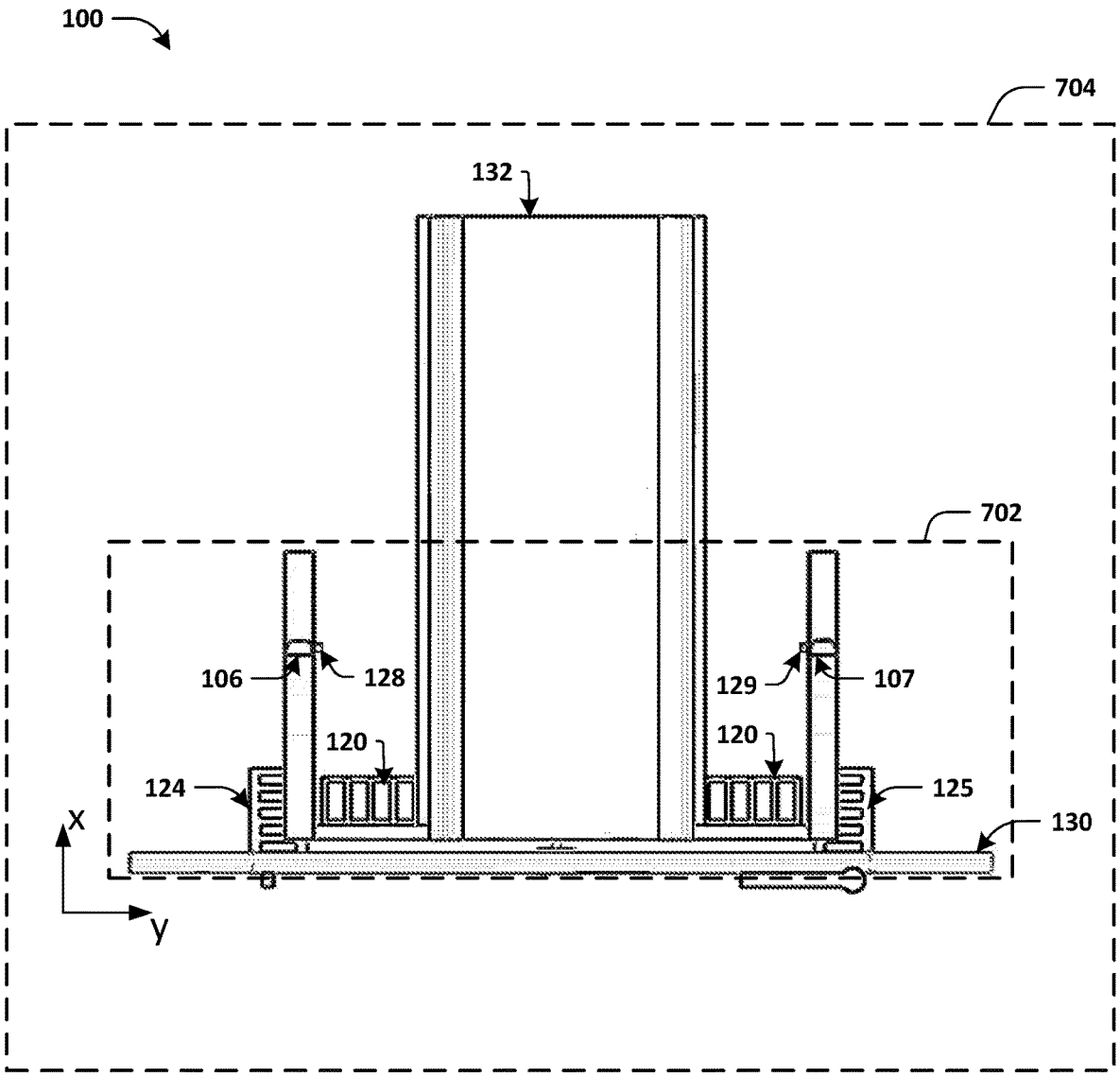
FIG. 7 is an illustration of one or more first positional parameters and/or one or more second positional parameters, according to one exemplary embodiment.

FIG. 7 illustrates an exemplary embodiment of the one or more first positional parameters (associated with safe operation of the exercise machine 100) and/or the one or more second positional parameters (associated with unsafe operation of the exercise machine 100).

In some embodiments, the one or more first positional parameters may be indicative of a first area 702 associated with safe operation of the exercise machine 100. The first area 702 may comprise a portion of a horizontal plane, such as a plane defined by an x-axis and a y-axis shown in FIG. 7. In an example, the first area 702 corresponds to one or more ranges of horizontal coordinates, such as a range of x-axis coordinates associated with the x-axis and/or a range of y-axis coordinates associated with the y-axis. In some embodiments, one or more positional values associated with the barbell 130 may be analyzed to determine whether the barbell 130 is within the first area 702. In some embodiments, it may be determined that the barbell 130 is within the first area 702 based upon a determination that one or more horizontal coordinates of at least a portion of the barbell 130 are within the one or more ranges of horizontal coordinates of the first area 702. For example, it may be determined that the barbell 130 is within the first area 702 based upon a determination that one or more x-axis coordinates and/or one or more y-axis coordinates of at least a portion of the barbell 130 are within the range of x-axis coordinates and/or the range of y-axis coordinates, respectively. In some embodiments, it may be determined that an unsafe condition is met based upon a determination that the barbell 702 is not fully within the first area 702 (such as where one or more horizontal coordinates of at least a portion of the barbell 130 are not within the one or more ranges of horizontal coordinates of the first area 702). Alternatively and/or additionally, it may be determined that an unsafe condition is met based upon a determination that the barbell 702 is fully outside the first area 702.

In some embodiments, the one or more second positional parameters may be indicative of a second area 704, at least a portion of which is shown in FIG. 7, associated with unsafe operation of the exercise machine 100. The second area 704 may comprise a portion of the horizontal plane that excludes the first area 702. In some embodiments, one or more positional values associated with the barbell 130 may be analyzed to determine whether the barbell 130 is within the second area 704. In some embodiments, it may be determined that the barbell 130 is within the second area 704 responsive to a determination that one or more horizontal coordinates of at least a portion of the barbell 130 are within one or more ranges of horizontal coordinates of the second area 704. In some embodiments, it may be determined that an unsafe condition is met based upon a determination that at least a portion of the barbell 702 is within the second area 704. Alternatively and/or additionally, it may be determined that an unsafe condition is met based upon a determination that the barbell 702 is fully within the second area 704.

FIGS. 8A-8B illustrate an exemplary embodiment associated with determining whether an unsafe condition associated with the exercise machine 100 is met.

In some embodiments, the one or more first positional parameters and/or the one or more second positional values may be associated with a reference orientation 802 (shown in FIGS. 8A-8B). In some embodiments, the reference orientation 802 may correspond to a line that is parallel to the y-axis and which intersects with the barbell 130 at at least one point. In some embodiments, a first angle of tilt 804 (shown in FIG. 8A) with respect to the reference orientation 802 and/or a second angle of tilt 806 (shown in FIG. 8B) with respect to the reference orientation 802 may be determined.

In some embodiments, the one or more first positional parameters may be indicative of a first range of angles of tilt (e.g., 0 degrees to 20 degrees and/or a different range), for comparison with the first angle of tilt 804, associated with safe operation of the exercise machine 100. In some embodiments, it may be determined that an unsafe condition is met based upon a determination that the first angle of tilt 804 is not within the first range of angles of tilt. Alternatively and/or additionally, the one or more first positional parameters may be indicative of a second range of angles of tilt (e.g., 0 degrees to 15 degrees and/or a different range), for comparison with the second angle of tilt 806, associated with safe operation of the exercise machine 100. In some embodiments, it may be determined that an unsafe condition is met based upon a determination that the second angle of tilt 806 is not within the second range of angles of tilt.

In some embodiments, the one or more second positional parameters may be indicative of a third range of angles of tilt (e.g., greater than 20 degrees and/or a different range), for comparison with the first angle of tilt 804, associated with unsafe operation of the exercise machine 100. In some embodiments, it may be determined that an unsafe condition is met based upon a determination that the first angle of tilt 804 is within the third range of angles of tilt. Alternatively and/or additionally, the one or more second positional parameters may be indicative of a fourth range of angles of tilt (e.g., greater than 15 degrees and/or a different range), for comparison with the second angle of tilt 806, associated with unsafe operation of the exercise machine 100. In some embodiments, it may be determined that an unsafe condition is met based upon a determination that the second angle of tilt 806 is within the fourth range of angles of tilt.

Alternatively and/or additionally, the one or more second positional parameters may be indicative of a first threshold angle of tilt (e.g., 20 degrees and/or a different threshold) for comparison with the first angle of tilt 804. In some embodiments, it may be determined that an unsafe condition is met based upon a determination that the first angle of tilt 804 exceeds the first threshold angle of tilt. Alternatively and/or additionally, the one or more second positional parameters may be indicative of a second threshold angle of tilt (e.g., 15 degrees and/or a different threshold) for comparison with the second angle of tilt 806. In some embodiments, it may be determined that an unsafe condition is met based upon a determination that the second angle of tilt 806 exceeds the second threshold angle of tilt.

The one or more safety parameters may be indicative of one or more first directional parameters associated with safe operation of the exercise machine 100 (and/or safe usage of the exercise machine 100) and/or one or more second directional parameters associated with unsafe operation of the exercise machine 100 (and/or unsafe usage of the exercise machine 100). In some embodiments, using one or more of the techniques provided herein (such as in the foregoing description), it may be determined whether an unsafe condition is met based upon the one or more first directional parameters, the one or more second directional parameters and/or one or more directional values of the first set of values.

The one or more safety parameters may be indicative of one or more first velocity parameters associated with safe operation of the exercise machine 100 (and/or safe usage of the exercise machine 100) and/or one or more second velocity parameters associated with unsafe operation of the exercise machine 100 (and/or unsafe usage of the exercise machine 100). In some embodiments, using one or more of the techniques provided herein (such as in the foregoing description), it may be determined whether an unsafe condition is met based upon the one or more first velocity parameters, the one or more second velocity parameters and/or one or more velocity values of the first set of values.

The one or more safety parameters may be indicative of one or more first acceleration parameters associated with safe operation of the exercise machine 100 (and/or safe usage of the exercise machine 100) and/or one or more second acceleration parameters associated with unsafe operation of the exercise machine 100 (and/or unsafe usage of the exercise machine 100). In some embodiments, using one or more of the techniques provided herein (such as in the foregoing description), it may be determined whether an unsafe condition is met based upon the one or more first acceleration parameters, the one or more second acceleration parameters and/or one or more acceleration values of the first set of values.

In some embodiments, responsive to a determination that an unsafe condition is met, the controller may perform one or more safety operations using one or more of the techniques provided herein, such as in the foregoing description.

By analyzing signals received from the one or more first sensors and/or periodically (and/or continuously) comparing values (e.g., at least one of positional values, directional values, velocity values, acceleration values, etc. associated with the barbell 130) determined based upon the signals with the one or more safety parameters, an unsafe condition may be detected. Examples of unsafe conditions that may be detected comprise at least one of the barbell 130 being tilted at an angle exceeding a threshold, the barbell 130 moving in a direction that does not correspond to an exercise process being performed, the barbell 130 moving with a velocity greater than a threshold velocity (e.g., such as where the user's grasp on the barbell 130 is released and/or the user drops the barbell 130), etc. By performing the one or more safety operations, a safety risk associated with an unsafe condition is reduced and/or minimized as compared with conventional weight systems that are prone to accidents. Thus, detecting unsafe conditions using one or more of the techniques provided herein and/or performing the one or more safety operations responsive to detecting an unsafe condition leads to safer operation and/or usage of the exercise machine 100.

In some embodiments, the one or more inputs, based upon which the controller is configured to control the motor 102, comprises one or more resistance settings. The controller may be configured to set the amount of force, applied by the motor 102 to the barbell 130, to equivalent to a resistance indicated by the one or more resistance settings. For example, a net force applied by the motor 102 to the barbell 130 may be equivalent to the resistance indicated by the one or more resistance settings. In an example, the resistance indicated by the one or more resistance settings may be 50 pounds and/or the net force applied by the motor 102 to the barbell 130 may be equivalent to a resistance of 50 pounds to movement of the barbell 130 (e.g., the one or more forces applied by the motor 102 to the barbell 130 may provide a resistance equivalent to 50 pounds to movement of the barbell 130 in at least one phase of an exercise process performed using the exercise machine).

In some embodiments, the controller may control the motor 102 based upon one or more feedback signals associated with the resistance applied to the barbell 130 by the motor. For example, the one or more feedback signals may be received from one or more sensors, such as one or more load sensors and/or one or more other types of sensors. In some embodiments, the one or more feedback signals may be indicative of a force, applied by the user, on the barbell 130 and/or a force, applied by the motor 102, on the barbell 130. Alternatively and/or additionally, the one or more feedback signals may be indicative of a resistance applied by the motor 102 to the barbell 130. Alternatively and/or additionally, the one or more feedback signals may be indicative of an interaction force between the user and the exercise machine. The controller may monitor and/or analyze the one or more feedback signals continuously and/or periodically. The controller may regulate the resistance applied by the motor to the barbell 130 (such as by controlling and/or adjusting the one or more forces applied by the motors) based upon the one or more feedback signals.

In some embodiments, the controller may control the motor 102 such that the resistance applied by the motor 102 to the barbell 130 is in accordance with the one or more resistance settings. In some embodiments, the one or more resistance settings may be indicative of a constant resistance throughout the first exercise process. Accordingly, the controller may control the motor 102 such that the resistance applied by the motor 102 to the barbell 130 is equivalent to the constant resistance throughout the first exercise process.

In some embodiments, the one or more resistance settings may be indicative of a plurality of resistances associated with a plurality of conditions. The controller may be configured to control the motor 102 such that the resistance applied by the motor 102 to the barbell 130 is equivalent to a resistance of the plurality of resistances when a condition of the plurality of conditions is met.

In an example, the plurality of resistances may comprise a first resistance associated with a first condition of the plurality of conditions and a second resistance associated with a second condition of the plurality of conditions. The controller may be configured to control the motor 102 such that the resistance applied by the motor 102 to the barbell 130 is equivalent to the first resistance when the first condition is met. The controller may be configured to control the motor 102 such that the resistance applied by the motor 102 to the barbell 130 is equivalent to the second resistance when the second condition is met.

In some embodiments, the plurality of conditions may be associated with a plurality of phases of the first exercise process. A phase of the plurality of phases may correspond to a phase of the first exercise process (e.g., at least one of eccentric phase, concentric phase, isometric phase, etc.). Alternatively and/or additionally, a condition of the plurality of conditions may be associated with a portion of a phase of the first exercise process (e.g., at least one of a portion of the eccentric phase, a portion of the concentric phase, a portion of the isometric phase, etc.).

In some embodiments, a current condition may be determined based upon one or more signals received from the one or more first sensors (and/or one or more other sensors). For example, the controller may determine the current phase and/or a current portion of the current phase using one or more of the techniques provided herein, such as in the foregoing description.

In some embodiments, the plurality of conditions may be associated with a plurality of periods of time of the first exercise process. For example, a first condition of the plurality of conditions may be associated with a first period of time of the plurality of periods of time, a second condition of the plurality of conditions may be associated with a second period of time of the plurality of periods of time, etc.

The first exercise process performed using the exercise machine may correspond to one or more sets of the exercise, where each set of the one or more sets is performed by performing one or more repetitions of the exercise. In some embodiments, the first exercise process may be associated with a plurality of repetitions of an exercise (e.g., a repetition of the plurality of repetitions may correspond to a complete performance of the exercise, such as a complete performance of both lowering the barbell 130 of the eccentric phase and lifting the barbell 130 of the concentric phase). In some embodiments, the one or more resistance settings may be indicative of varying resistances across the plurality of repetitions. The controller may control the motor 102 based upon a current repetition of the plurality of repetitions. For example, each repetition of the plurality of repetitions may be associated with one or more resistances, where one or more resistances associated with a repetition of the plurality of repetitions may be different than one or more resistances associated with a different repetition of the plurality of repetitions.

In some embodiments, the controller may control the motor 102 such that the resistance applied to the barbell 130 varies over time. For example, the one or more resistance settings may be indicative of one or more resistance functions. A resistance function of the one or more resistance functions may correspond to an initial resistance, a last resistance and/or a rate of resistance change. For example, a first resistance function of the one or more resistance functions may be associated with a condition of the plurality of conditions, a phase of the first exercise process, a portion of a phase of the first exercise process, and/or a repetition of the exercise process.

For example, the controller may control the motor 102 based upon the first resistance function based upon a determination that the condition associated with the first resistance function is met. Alternatively and/or additionally, the controller may control the motor 102 based upon the first resistance function based upon a determination that the current phase of the first exercise process is the phase associated with the first resistance function. Alternatively and/or additionally, the controller may control the motor 102 based upon the first resistance function based upon a determination that the current portion of the current phase of the first exercise process is the portion of the phase associated with the first resistance function. Alternatively and/or additionally, the controller may control the motor 102 based upon the first resistance function based upon a determination that the current repetition of the first exercise process is the repetition associated with the first resistance function.

In some embodiments, the controller may control the motor 102 based upon the first resistance function using one or more of the techniques provided herein, such as in the foregoing description.

In some embodiments, the exercise machine 100 comprises a safety system configured to prevent the barbell 130 from falling onto the user using the exercise machine 100. In some embodiments, the safety system may comprise a first safety structure 106 (shown in FIG. 1 and FIGS. 3-5) and/or a second safety structure 107 (shown in FIG. 1 and FIGS. 4-6). In some embodiments, the bench 132 is between the first safety structure 106 and the second safety structure 107. In some embodiments, the first safety structure 106 is at a higher elevation than the bench 132. In some embodiments, the second safety structure 107 is at a higher elevation than the bench 132. In some embodiments, the first safety structure 106 and the second safety structure 107 correspond to a pair of blockers and/or stoppers configured to block the barbell 130 from falling below the first safety structure 106 and the second safety structure 107.

In some embodiments, the safety system comprises a first electromechanical safety stand 122 (shown in FIG. 1, FIG. 3 and FIG. 5) and/or a second electromechanical safety stand 123 (shown in FIG. 1 and FIGS. 5-6). In some embodiments, the first safety structure 106 is mounted on (and/or coupled to a top side of) the first electromechanical safety stand 122 and/or the second safety structure 107 is mounted on (and/or coupled to a top side of) the second electromechanical safety stand 123. In some embodiments, the first electromechanical safety stand 122 and/or the second electromechanical safety stand 123 comprise one or more height adjustment systems, such as at least one or more electric adjustment systems, one or more hydraulic adjustment systems, one or more pneumatic adjustment systems, etc. The one or more height adjustment systems may comprise at least one of one or more motors (e.g., one or more electric motors), one or more actuators (e.g., one or more safety actuators and/or one or more linear actuators), one or more cylinders, one or more pumps, etc. configured to change a height of the first electromechanical safety stand 122 and/or a height of the second electromechanical safety stand 123. Accordingly, the one or more height adjustment systems may be used for adjusting a vertical position of the first safety structure 106 and/or a vertical position of the second safety structure 107.

In some embodiments, the safety system comprises one or more safety sensors, such as comprising at least one of one or more ultrasonic sensors, one or more proximity sensors, one or more optical sensors, one or more image sensors, one or more cameras, one or more motion sensors, one or more infrared sensors, one or more load sensors, etc. For example, the safety system may comprise a first component 128 (shown in FIG. 1 and FIGS. 3-5) and/or a second component 129 (shown in FIG. 1 and FIGS. 4-5). In some embodiments, the first component 128 may be coupled to the first safety structure 106, the first electromechanical safety stand 122 and/or to a different object. Alternatively and/or additionally, the second component 129 may be coupled to the second safety structure 107, the second electromechanical safety stand 123 and/or to a different object. In some embodiments, the first component 128 may comprise at least one of a sensor of the one or more safety sensors, a transmitter, an emitter, etc. Alternatively and/or additionally, the second component 129 may comprise at least one of a sensor of the one or more safety sensors, a transmitter, an emitter, etc.

In some embodiments, the one or more safety sensors are configured to detect a position of the user, such as at least one of whether the user is between the first component 128 and the second component 129, a vertical position of a top-most surface of the user, a vertical position of a top-most surface of the user's chest, a vertical position of a top-most surface of a portion of the user's body on the bench 132, a thickness of at least a portion of the user's body on the bench 132, etc. In some embodiments, the one or more safety sensors are configured to transmit one or more signals, indicative of the position of the user, to the controller. In some embodiments, the controller is configured to control the first electromechanical safety stand 122 and/or the second electromechanical safety stand 123 based upon the one or more signals to adjust a vertical position of the first safety structure 106 and/or a vertical position of the second safety structure 107. For example, the controller may control the first electromechanical safety stand 122 and/or the second electromechanical safety stand 123 such that the first safety structure 106 and/or the second safety structure 107 are at a higher elevation than a portion of the user's body on the bench 132 (such as a portion of the user's body between the first safety structure 106 and/or the second safety structure 107). Alternatively and/or additionally, the controller may control the first electromechanical safety stand 122 and/or the second electromechanical safety stand 123 such that the vertical position of the first safety structure 106 and/or the vertical position of the second safety structure 107 are higher than a vertical position of a top-most portion of the user's body by a difference (e.g., a half inch, 1 inch, and/or a different difference). Alternatively and/or additionally, the controller may control the first electromechanical safety stand 122 and/or the second electromechanical safety stand 123 such that the vertical position of the first safety structure 106 and/or the vertical position of the second safety structure 107 are higher than a vertical position of a top-most portion of a portion of the user's body (such as a chest area and/or a different portion of the user's body on the bench 132) by a difference (e.g., a half inch, 1 inch, and/or a different difference).

In one example implementation, the one or more safety sensors comprise one or more ultrasonic sensors. An ultrasonic sensor (e.g., the first component 128 and/or the second component 129) of the one or more ultrasonic sensors may emit an ultrasonic wave and/or receive the ultrasonic wave reflected back by one or more objects, such as the user's body. A distance to the user's body may be determined based upon a time between emission of the ultrasonic wave and reception of the ultrasonic wave. Alternatively and/or additionally, one or more distances may be determined using the one or more ultrasonic sensors. A position of the user may be determined based upon the one or more distances. The controller may control the first electromechanical safety stand 122 and/or the second electromechanical safety stand 123 based upon the position determined based upon the one or more distances.

In one example implementation, the one or more safety sensors may comprise one or more optical sensors. For example, a first optical sensor of the one or more optical sensors may be positioned across from a light emitting element. In an example, the first component 128 comprises the first optical sensor and/or the second component 129 comprises the light emitting element (or vice-versa). In some embodiments, a light signal emitted by the light emitting element may be reached and/or detected by the first optical sensor when the first optical sensor and/or the light emitting element are at a higher elevation than at least a portion of the user's body. In some embodiments, responsive to a determination that the light signal is not reached and/or detected by the first optical sensor, the controller may be configured to extend the first electromechanical safety stand 122 and/or the second electromechanical safety stand 123 vertically until the light signal is reached and/or detected by the first optical sensor. In some embodiments, responsive to the light signal being reached and/or detected by the first optical sensor, the controller may extend the first electromechanical safety stand 122 further such that the vertical position of the first safety structure 106 and/or the vertical position of the first safety structure 106 are higher than the top-most portion of the user's body by a difference (e.g., a half inch, 1 inch, and/or a different difference) and/or higher than a portion of the user's body (such as a chest area and/or a different portion of the user's body on the bench 132) by a difference (e.g., a half inch, 1 inch, and/or a different difference).

In one example implementation, the one or more safety sensors may comprise one or more image sensors, one or more cameras, one or more infrared sensors, etc. The one or more safety sensors may transmit one or more signals, such as one or more infrared signals, one or more images, one or more videos, etc. to the controller. A position of the user (e.g., at least one of a vertical position of a top-most surface of the user, a vertical position of a top-most surface of the user's chest, a vertical position of a top-most surface of a portion of the user's body on the bench 132, a thickness of at least a portion of the user's body on the bench 132, etc.) may be determined based upon the one or more signals received from the one or more safety sensors. The controller may control the first electromechanical safety stand 122 and/or the second electromechanical safety stand 123 based upon the position determined based upon the one or more signals.

In some embodiments, the exercise machine 100 is configured such that the barbell 130 can be moved in all directions, such as similar to a barbell used with a conventional bench press machine and/or other free weights. Alternatively and/or additionally, unlike conventional mechanical and/or electromechanical exercise machines, motion of the barbell 130 may not be fixed one or more specific trajectories of motion. In some embodiments, resistance (and/or greater than a threshold amount of resistance) to movement of the barbell 130 along one or more planes of movement (e.g., frontal plane, sagittal plane and/or transverse plane) may not be applied by the exercise machine 100. For example, resistance (and/or greater than a threshold amount of resistance) to movement of the barbell 130 along a horizontal plane (e.g., a transverse plane and/or a plane parallel to a plane defined by the x-axis and the y-axis shown in FIG. 7) may not be applied by the exercise machine 100. Thus, exercise using the exercise machine 100 may provide for activating, strengthening, toning, working and/or conditioning stabilizer muscles (e.g., balance muscles) of the user, unlike conventional mechanical and/or electromechanical exercise machines.

Thus, unlike conventional mechanical and/or electromechanical exercise machines which provide merely for one or more specific trajectories of motion and thus prevent the user from activating stabilizer muscles, the exercise machine 100 provided herein may have benefits associated with usage of free weights (e.g., activating, strengthening, toning, working and/or conditioning stabilizer muscles) without disadvantages associated with usage of free weights (e.g., risk of injury from the user losing control of the free weights and/or a weight falling onto the user).

In some embodiments, the exercise machine 100 may be configured to support movement of the first pulley 118 and/or the second pulley 119 along a horizontal plane, such as parallel to the plane defined by the x-axis and the y-axis shown in FIG. 7. For example, the exercise machine 100 may comprise a first rail 124 (shown in FIG. 1 and FIG. 4) and/or a second rail 125 (shown in FIG. 1 and FIG. 4). In some embodiments, the first pulley 118 may be coupled to the first rail 124 (e.g., the first pulley 118 may be positioned and/or mounted on the first rail 124). In some embodiments, the first rail 124 may enable the first pulley 118 to move in a first horizontal direction and/or a second horizontal direction opposite the first horizontal direction. In some embodiments, the first horizontal direction and the second horizontal direction may be parallel to the x-axis shown in FIG. 7. In some embodiments, the second pulley 119 may be coupled to the second rail 125 (e.g., the second pulley 119 may be positioned and/or mounted on the second rail 125). In some embodiments, the second rail 125 may enable the second pulley 119 to move in the first horizontal direction and/or the second horizontal direction opposite the first horizontal direction. In some embodiments, rather than (and/or in addition to) using the first rail 124 and/or the second rail 125 to enable movement in the first horizontal direction and/or the second horizontal direction, the first pulley 118 and/or the second pulley 119 may be coupled to one or more other types of movement structures (e.g., one or more tracks and/or other structures) to enable movement in the first horizontal direction and/or the second horizontal direction. Alternatively and/or additionally, the first pulley 118 and/or the second pulley 119 may be coupled to one or more movement structures (e.g., one or more rails, one or more tracks and/or one or more other structures) configured to enable movement in one or more other directions rather than and/or in addition to the first horizontal direction and/or the second horizontal direction, such as in any horizontal direction along the horizontal plane (and/or in any other direction, such as at least one of vertically, vertically at an angle, etc.).

In some embodiments, the user may move the barbell 130 in various horizontal directions along the horizontal plane. The first pulley 118 and/or the second pulley 119 may move in the first horizontal direction and/or the second horizontal direction (and/or in the one or more other directions) in association with the horizontal movement of the barbell 130. For example, the first pulley 118 and/or the second pulley 119 may remain positioned under the barbell 130 (and/or within a threshold distance from under the barbell 130) as a result of the first rail 124 and/or the second rail 125 enabling the first pulley 118 and/or the second pulley 119 to move in association with the barbell 130. In some embodiments, by enabling the first pulley 118 and/or the second pulley 119 to move in association with the horizontal movement of the barbell 130, resistance (and/or greater than a threshold amount of resistance) may not be applied by the exercise machine 100 to the horizontal movement of the barbell 130. For example, resistance applied by the motor 102 via the first pulley 118 and/or the second pulley 119 may be applied in a desired direction, such as vertically downwards (e.g., resistance (and/or greater than a threshold amount of resistance) applied by the motor 102 may not be applied to the horizontal movement of the barbell 130).

In some embodiments, the exercise machine 100 may be configured to support movement of the motor 102 along a horizontal plane, such as parallel to the plane defined by the x-axis and the y-axis shown in FIG. 7. For example, the exercise machine 100 may comprise a third rail 120 (shown in FIG. 1 and FIG. 4). In some embodiments, the third rail may be between the first rail 124 and the second rail 125. In some embodiments, the motor 102 may be coupled to the third rail 120 (e.g., the motor 102 may be positioned and/or mounted on the third rail 120). In some embodiments, the third rail 120 may enable the motor 102 to move in a third horizontal direction and/or a fourth horizontal direction opposite the third horizontal direction. In some embodiments, the third horizontal direction and/or the fourth horizontal direction may be parallel to the y-axis shown in FIG. 7 (e.g., the third horizontal direction and/or the fourth horizontal direction may be perpendicular to the first horizontal direction and/or the second horizontal direction). In some embodiments, the motor 102 may move along the third rail 120 in the third horizontal direction and/or the fourth horizontal direction in association with one or more forces of the motor 102 being applied to the barbell 130 unevenly, such as where force applied to a first side of the barbell 130 (and/or a gradient of force on the first side of the barbell 130) is greater than a force applied to a second side of the barbell 130 (and/or a gradient of force on the second side of the barbell 130), where the first side of the barbell 130 is opposite the second side of the barbell 130. For example, the third rail 120 may enable the motor 102 to move in one of the third horizontal direction or the fourth horizontal direction that is towards the first side of the barbell 130 with more force, and thus cause the one or more forces of the motor 102 to be applied to the barbell 130 evenly (e.g., with equal forces applied to both sides of the barbell 130). By causing the one or more forces of the motor 102 to be applied to the barbell 130 evenly, muscles on opposite sides of the user may be evenly activated, strengthened, toned, worked and/or conditioned when using the exercise machine 100 which may prevent uneven muscle growth.

In some embodiments, rather than (and/or in addition to) using the third rail 120 to enable movement in the third horizontal direction and/or the fourth horizontal direction, the motor 102 may be coupled to one or more other types of movement structures (e.g., one or more tracks and/or other structures) to enable movement in the third horizontal direction and/or the fourth horizontal direction. Alternatively and/or additionally, the motor 102 may be coupled to one or more movement structures (e.g., one or more rails, one or more tracks and/or one or more other structures) configured to enable movement in one or more other directions rather than and/or in addition to the third horizontal direction and/or the fourth horizontal direction, such as in any horizontal direction along the horizontal plane (and/or in any other direction, such as at least one of vertically, vertically at an angle, etc.). In some embodiments, one or more other motors are used rather than (and/or in addition to) using the motor 102. The one or more other motors may assist the motor 102 in applying resistance to the barbell 130 and/or may have one or more functionalities different than and/or separate from the motor 102 (e.g., the one or more functionalities may comprise moving one or more components other than the barbell 130 and/or performing one or more other actions described herein). Similar to the motor 102, the one or more other motors may or may not be coupled to (and/or may or may not move along) the third rail 120 and/or one or more other movement structures. The one or more other motors and/or the motor 102 may be controlled using the controller. Alternatively and/or additionally, the one or more other motors and/or the motor 102 may be controlled using one or more separate and/or different controllers (e.g., one or more microcontrollers, one or more computers and/or one or more other types of control devices).

In some embodiments, the barbell 130 may tilt downwards on a first side and/or upwards on a second side, such as shown in FIG. 8B. On a conventional bench press with weights, when a barbell is tilted such as shown in FIG. 8B, the force of the barbell on the user using the bench press may be uneven (e.g., a force on a lower side may be greater than a force on a higher side). In some embodiments, the exercise machine 100 may be configured such that, when the barbell 130 tilts downwards on the first side and/or upwards on the second side (such as shown in FIG. 8B), the force applied to the barbell 130 is applied evenly on the first side and the second side of the barbell 130. For example, the force may be applied evenly by regulating the force applied by the motor 102 to the first side and/or the second side and/or by enabling the motor 102 to move (such as using the third rail 120 and/or one or more other movement structures). By applying the force evenly on the first side and the second side of the barbell 130, muscles on opposite sides of the user may be evenly activated, strengthened, toned, worked and/or conditioned when using the exercise machine 100 (which may prevent uneven muscle growth). Alternatively and/or additionally, the exercise machine 100 may be configured such that, when the barbell 130 tilts downwards on the first side and/or upwards on the second side (such as shown in FIG. 8B), more force is applied on the first side of the barbell 130 such as to simulate a conventional bench press with weights.

In some embodiments, the exercise machine 100 may comprise an energy generator 126 (shown in FIG. 1 and FIG. 6) configured to generate electricity, such as by converting mechanical energy of an exercise process performed using the exercise machine 100 to electrical energy. For example, the energy generator 126 may comprise a capacitor (e.g., an ultra-capacitor) configured to store energy. For example, the energy stored by the energy generator 126 may comprise energy obtained from the motor, such as when work of the motor is negative. In some embodiments, the energy generator 126 may supply the motor 102, the controller, and/or one or more other components of the exercise machine 100 (and/or other exercise machines) with the stored energy.

In some embodiments, the exercise machine 100 may comprise a device 114. The device 114 may comprise at least one of a display (e.g., a touchscreen and/or a different type of display), a microphone, a speaker, etc. In some embodiments, the device 114 may comprise the interface device described in the foregoing description. In some embodiments, the device 114 may be positioned such that the display of the device 114 faces the user when the user is using the exercise machine 100 (e.g., the device 114 may be positioned over and/or facing the bench 132 of the exercise machine 100). In some embodiments, the device 114 may comprise the controller of the exercise machine 100.

Figure 9:
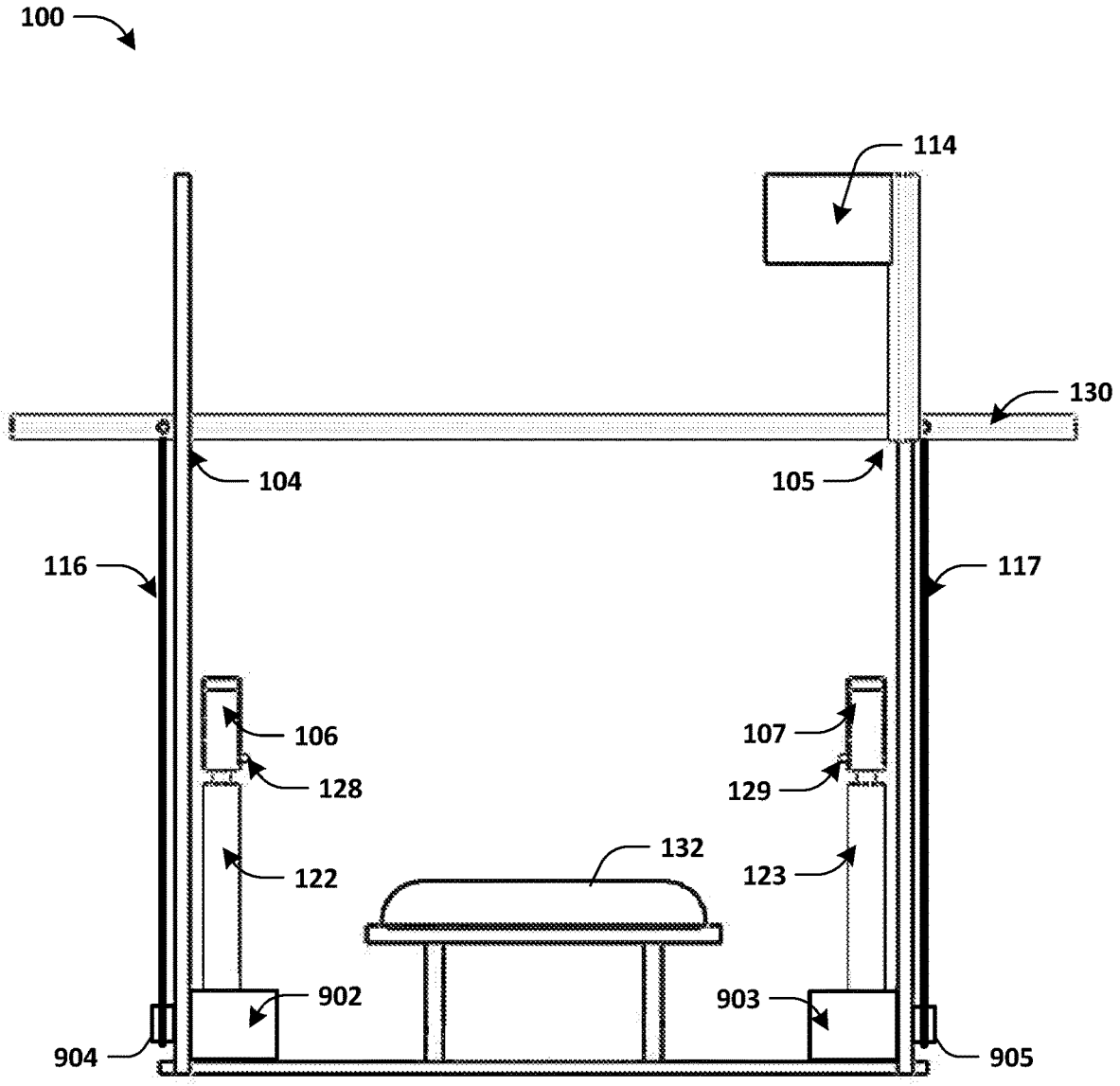
FIG. 9 is an illustration of an exercise machine comprising a first motor and/or a second motor, according to one exemplary embodiment.

FIG. 9 illustrates an exemplary embodiment of the exercise machine 100 comprising a first motor 902 and/or a second motor 903. For example, rather than (and/or in addition to) the exercise machine 100 comprising the motor 102, the first pulley 118 and/or the second pulley 119, the exercise machine 100 may comprise the first motor 902 and/or the second motor 903.

In some embodiments, the first driving element 116 may be coupled to the first motor 902 via a driving component 904 (e.g., a pulley, such as a driving pulley) coupled to the first motor 902. In some embodiments, the first driving element 116 may be coupled (e.g., affixed and/or fixedly coupled) to the driving component 904 of the first motor 902 at a first part (e.g., a first end) of the first driving element 116 and/or the first driving element 116 may be coupled (e.g., affixed and/or fixedly coupled) to the barbell 130 at a second part (e.g., a second end opposite the first end) of the first driving element 116. In some embodiments, the first motor 902 may generate force and/or apply the force to the barbell 130 via the first driving element 116.

Alternatively and/or additionally, the second driving element 117 may be coupled to the second motor 903 via a driving component 905 (e.g., a pulley, such as a driving pulley) coupled to the second motor 903. In some embodiments, the second driving element 117 may be coupled (e.g., affixed and/or fixedly coupled) to the driving component 905 of the second motor 903 at a first part (e.g., a first end) of the second driving element 117 and/or the second driving element 117 may be coupled (e.g., affixed and/or fixedly coupled) to the barbell 130 at a second part (e.g., a second end opposite the first end) of the second driving element 117. In some embodiments, the second motor 903 may generate force and/or apply the force to the barbell 130 via the second driving element 117.

In some embodiments, the exercise machine 100 may be configured to support movement of the first motor 902 and/or the second motor 903 along a horizontal plane, such as parallel to the plane defined by the x-axis and the y-axis shown in FIG. 7. For example, the first motor 902 may be coupled to the first rail 124 (e.g., the first motor 902 may be positioned and/or mounted on the first rail 124). In some embodiments, the first rail 124 may enable the first motor 902 to move in the first horizontal direction and/or the second horizontal direction opposite the first horizontal direction. In some embodiments, the second motor 903 may be coupled to the second rail 125 (e.g., the second motor 903 may be positioned and/or mounted on the second rail 125). In some embodiments, the second rail 125 may enable the second motor 903 to move in the first horizontal direction and/or the second horizontal direction opposite the first horizontal direction. In some embodiments, rather than (and/or in addition to) using the first rail 124 and/or the second rail 125 to enable movement in the first horizontal direction and/or the second horizontal direction, the first motor 902 and/or the second motor 903 may be coupled to one or more other types of movement structures (e.g., one or more tracks and/or other structures) to enable movement in the first horizontal direction and/or the second horizontal direction. Alternatively and/or additionally, the first motor 902 and/or the second motor 903 may be coupled to one or more movement structures (e.g., one or more rails, one or more tracks and/or one or more other structures) configured to enable movement in one or more other directions rather than and/or in addition to the first horizontal direction and/or the second horizontal direction, such as in any horizontal direction along the horizontal plane (and/or in any other direction, such as at least one of vertically, vertically at an angle, etc.).

In some embodiments, the user may move the barbell 130 in various horizontal directions along the horizontal plane. The first motor 902 and/or the second motor 903 may move in the first horizontal direction and/or the second horizontal direction (and/or the one or more other directions) in association with the horizontal movement of the barbell 130. For example, the first motor 902 (and/or the driving component 904) and/or the second motor 903 (and/or the driving component 905) may remain positioned under the barbell 130 (and/or within a threshold distance from under the barbell 130) as a result of the first rail 124 and/or the second rail 125 enabling the first motor 902 and/or the second motor 903 to move in association with the barbell 130. In some embodiments, by enabling the first motor 902 and/or the second motor 903 to move in association with the horizontal movement of the barbell 130, resistance (and/or greater than a threshold amount of resistance) may not be applied by the exercise machine 100 to the horizontal movement of the barbell 130. For example, resistance applied by the first motor 902 and/or the second motor 903 may be applied in a desired direction, such as vertically downwards (e.g., resistance (and/or greater than a threshold amount of resistance) applied by the first motor 902 and/or the second motor 903 may not be applied to the horizontal movement of the barbell 130).

In some embodiments, the exercise machine 100 may comprise an exercise bar different than the barbell 130, such as a bar, a barbell, a grip, a dumbbell, a shaped bar (e.g., an EZ curl bar, a triceps bar, a hexagon-shaped bar, etc.) a handle, a bar surrounded by a roller pad, a plate to which the user applies force using one or more of the user's body parts and/or a different type of exercise bar.

In some embodiments, the exercise machine 100 may be used by users having injuries, disabled users, elderly users, blind users, etc. Alternatively and/or additionally, the exercise machine 100 may be equipped with special equipment such that users having injuries, disabled users, elderly users, blind users, etc. may use the exercise machine 100. In an example, the exercise machine 100 may be configured such that a user may use the exercise machine 100 while seated on a wheelchair.

In some embodiments, the exercise machine 100 may be fixed to a certain location, such as via at least one of nuts, bolts, etc. Alternatively and/or additionally, the exercise machine 100 may be transportable and/or portable. For example, the exercise machine 100 may be carried and/or moved. In an example, one or more components of the exercise machine 100 may be foldable to ease transporting the exercise machine 100 from one location to another.

A computing device may be provided. In an example, the controller, the interface device, the device 114, the client device, the second client device and/or one or more servers associated with the exercise interface may comprise the computing device. The computing device may comprise a control circuit, a processor installed in the control circuit and/or memory installed in the control circuit and coupled to the processor. The memory may comprise processor-executable instructions that when executed cause performance of one, some and/or all of the techniques, acts and/or operations provided herein.

It may be appreciated that embodiments described herein are exemplary and/or illustrative, and that any combination of one or more of the components described herein are contemplated.

Unless specified otherwise, "first," "second," and/or the like are not intended to imply a temporal aspect, a spatial aspect, an ordering, discreteness, etc. Rather, such terms are merely used as identifiers, names, etc. for features, elements, items, etc. For example, a first object and a second object generally correspond to object A and object B or two different or two identical objects or the same object.

Moreover, "example" is used herein to mean serving as an instance, illustration, etc., and not necessarily as advantageous. As used herein, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B, at least one of A or B and/or the like generally means A or B or both A and B. Furthermore, to the extent that "includes", "having", "has", "with", and/or variants thereof are used in either the detailed description or the claims, such terms are intended to be inclusive in a manner similar to the term "comprising".

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments and/or examples are provided herein. The order in which some or all of the operations are described herein should not be construed as to imply that these operations are necessarily order dependent. Alternative ordering will be appreciated by one skilled in the art having the benefit of this description. Further, it will be understood that not all operations are necessarily present in each embodiment and/or example provided herein. Also, it will be understood that not all operations are necessary in some embodiments and/or examples.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An exercise machine, comprising:

an exercise bar;

a driving element coupled to the exercise bar;

a motor coupled to the driving element, wherein the motor is configured to apply force to the exercise bar via the driving element;

one or more movement structures configured to enable movement of the motor in two or more directions, wherein the motor is configured to move in a first direction at one or more first times and a second direction at one or more second times based upon a first application of force to a first side of the exercise bar and a second application of force to a second side of the exercise bar being uneven;

one or more sensors for detection of a phase of an exercise process; and a controller configured to control the motor based upon the phase of the exercise process, wherein:

the controller is configured to set a first force applied by the motor to equivalent to a first resistance during an eccentric phase of the exercise process; and the controller is configured to set a second force applied by the motor to equivalent to a second resistance during a concentric phase of the exercise process.

2. The exercise machine of claim 1, comprising:

one or more sensors configured to:

detect at least one of a direction of motion of the exercise bar, a ground reaction force, or an acceleration of the exercise bar; and transmit one or more signals to the controller, wherein:

each signal of the one or more signals is indicative of at least one of a direction of motion of the exercise bar, a ground reaction force, or an acceleration of the exercise bar detected by the one or more sensors; and the controller is configured to control the motor based upon the one or more signals.

3. The exercise machine of claim 2, wherein:

the controller is configured to:

compare at least one of one or more positions, one or more directions, one or more velocities, one or more forces, or one or more accelerations indicated by the one or more signals with one or more safety parameters to determine whether an unsafe condition is met; and at least one of stop the motor from applying the force or reduce the force of the motor responsive to a determination that the unsafe condition is met.

4. The exercise machine of claim 1, wherein:

the driving element comprises at least one of a rope, a cable, a belt, or a chain.

5. The exercise machine of claim 1, comprising:

a safety system configured to prevent the exercise bar from falling onto a user of the exercise machine, the safety system comprising:

a first safety structure; and a second safety structure;

one or more sensors configured to detect a position of the user and transmit a signal indicative of the position of the user to the controller;

a first electromechanical safety stand on which the first safety structure is mounted; and a second electromechanical safety stand on which the second safety structure is mounted, wherein the controller is configured to control the first electromechanical safety stand and the second electromechanical safety stand based upon the signal to adjust a vertical position of the first safety structure and a vertical position of the second safety structure.

6. A bench press machine, comprising:

a bench;

a barbell;

a barbell support structure, comprising:

a first barbell support component; and a second barbell support component, wherein the first barbell support component and the second barbell support component are configured to support the barbell;

a driving mechanism coupled to the barbell, wherein the driving mechanism is configured to move in one or more first directions based upon a first horizontal movement of the barbell and the driving mechanism is configured to move in one or more second directions based upon a second horizontal movement of the barbell;

one or more motors coupled to the driving mechanism, wherein the one or more motors are configured to apply force to the barbell via the driving mechanism;

one or more sensors for detection of a phase of an exercise process; and a controller configured to control the one or more motors based upon the phase of the exercise process, wherein:

the controller is configured to set a first force applied by the one or more motors to equivalent to a first resistance during an eccentric phase of the exercise process; and the controller is configured to set a second force applied by the one or more motors to equivalent to a second resistance during a concentric phase of the exercise process one or more sensors configured to record one or more videos of a user using the bench press machine; and a display device configured to display the one or more videos in real-time or in near real-time.

7. The bench press machine of claim 6, wherein the driving mechanism comprises:

a first driving element, comprising at least one of a first rope, a first cable, a first belt, or a first chain, coupled to the one or more motors and a first portion of the barbell; and a second driving element, comprising at least one of a second rope, a second cable, a second belt, or a second chain, coupled to the one or more motors and a second portion of the barbell.

8. The bench press machine of claim 7, wherein the driving mechanism comprises:

a first pulley coupled to the first driving element; and a second pulley coupled to the second driving element.

9. The bench press machine of claim 8, wherein:

the first pulley at least one of underlies the first portion of the barbell or has at least a portion that is level with at least a portion of the one or more motors; and the second pulley at least one of underlies the second portion of the barbell or has at least a portion that is level with at least a portion of the one or more motors.

10. The bench press machine of claim 8, comprising:

a first rail coupled to the first pulley and configured to enable the first pulley to move in a first horizontal direction and a second horizontal direction opposite the first horizontal direction; and a second rail coupled to the second pulley and configured to enable the second pulley to move in the first horizontal direction and the second horizontal direction.

11. The bench press machine of claim 10, comprising:

a third rail coupled to the one or more motors and configured to enable the one or more motors to move in a third horizontal direction and a fourth horizontal direction opposite the third horizontal direction, wherein the third horizontal direction is perpendicular to the first horizontal direction.

12. The bench press machine of claim 6, comprising:

a safety system configured to prevent the barbell from falling onto a user of the bench press machine, the safety system comprising:

a first safety structure at a higher elevation than the bench; and a second safety structure at a higher elevation than the bench.

13. The bench press machine of claim 12, comprising:

one or more sensors configured to detect a position of the user and transmit a signal indicative of the position of the user to the controller;

a first electromechanical safety stand on which the first safety structure is mounted; and a second electromechanical safety stand on which the second safety structure is mounted, wherein:

the bench is between the first electromechanical safety stand and the second electromechanical safety stand; and the controller is configured to control the first electromechanical safety stand and the second electromechanical safety stand based upon the signal to adjust a vertical position of the first safety structure and a vertical position of the second safety structure.

14. The bench press machine of claim 6, comprising:

one or more sensors configured to record one or more videos of a user using the bench press machine; and a display device configured to display the one or more videos in real-time or in near real-time.

15. An exercise machine, comprising:

an exercise bar;

a driving element coupled to the exercise bar;

a motor coupled to the driving element, wherein the motor is configured to apply force to the exercise bar via the driving element;

one or more sensors for detection of a phase of an exercise process;

a controller configured to control the motor based upon the phase of the exercise process, wherein:

the controller is configured to set a first force applied by the motor to equivalent to a first resistance during an eccentric phase of the exercise process; and the controller is configured to set a second force applied by the motor to equivalent to a second resistance during a concentric phase of the exercise process;

a safety system configured to prevent the exercise bar from falling onto a user of the exercise machine, the safety system comprising:

a first safety structure; and a second safety structure;

one or more sensors configured to detect a position of the user and transmit a signal indicative of the position of the user to the controller;

a first electromechanical safety stand on which the first safety structure is mounted; and a second electromechanical safety stand on which the second safety structure is mounted, wherein the controller is configured to control the first electromechanical safety stand and the second electromechanical safety stand based upon the signal to adjust a vertical position of the first safety structure and a vertical position of the second safety structure.

16. A bench press machine, comprising:

a bench;

a barbell;

a barbell support structure, comprising:

a first barbell support component; and a second barbell support component, wherein the first barbell support component and the second barbell support component are configured to support the barbell;

a driving mechanism coupled to the barbell, wherein the driving mechanism is configured to move in one or more first directions based upon a first horizontal movement of the barbell and the driving mechanism is configured to move in one or more second directions based upon a second horizontal movement of the barbell, wherein the driving mechanism comprises:

a first driving element, comprising at least one of a first rope, a first cable, a first belt, or a first chain, coupled to one or more motors and a first portion of the barbell;

a second driving element, comprising at least one of a second rope, a second cable, a second belt, or a second chain, coupled to the one or more motors and a second portion of the barbell;

a first pulley coupled to the first driving element; and a second pulley coupled to the second driving element;

the one or more motors coupled to the driving mechanism, wherein the one or more motors are configured to apply force to the barbell via the driving mechanism;

one or more sensors for detection of a phase of an exercise process; and a controller configured to control the one or more motors based upon the phase of the exercise process, wherein:

the controller is configured to set a first force applied by the one or more motors to equivalent to a first resistance during an eccentric phase of the exercise process; and the controller is configured to set a second force applied by the one or more motors to equivalent to a second resistance during a concentric phase of the exercise process.

* * * * *